US010526137B2

(12) United States Patent
Dworkin

(10) Patent No.: US 10,526,137 B2
(45) Date of Patent: Jan. 7, 2020

(54) REFUSE CONTAINER LOCKING APPARATUS AND METHOD

(71) Applicant: Darryl R. Dworkin, Incline Village, NV (US)

(72) Inventor: Darryl R. Dworkin, Incline Village, NV (US)

(73) Assignee: DRDesigns, LLC, Incline Village, NV (US)

( * ) Notice: Subject to any disclaimer, the term of this patent is extended or adjusted under 35 U.S.C. 154(b) by 0 days.

(21) Appl. No.: 15/879,290

(22) Filed: Jan. 24, 2018

(65) Prior Publication Data

US 2019/0161271 A1 May 30, 2019

Related U.S. Application Data

(60) Provisional application No. 62/592,274, filed on Nov. 29, 2017, provisional application No. 62/598,361, filed on Dec. 13, 2017.

(51) Int. Cl.

| | |
|---|---|
| ***B65F 1/16*** | (2006.01) |
| ***B65F 1/02*** | (2006.01) |
| *B65F 1/14* | (2006.01) |

(52) U.S. Cl.

CPC ..... *B65F 1/1615* (2013.01); *B65F 1/02* (2013.01); *B65F 1/1473* (2013.01); *B65F 2210/148* (2013.01)

(58) Field of Classification Search

CPC combination set(s) only.
See application file for complete search history.

(56) References Cited

U.S. PATENT DOCUMENTS

| | | | |
|---|---|---|---|
| 1,256,132 | A | 2/1918 | Hillburg |
| 1,354,646 | A | 10/1920 | Heintzelman |

(Continued)

FOREIGN PATENT DOCUMENTS

| | | |
|---|---|---|
| CN | 205224868 | 5/2016 |
| EP | 0699600 | 3/1996 |

(Continued)

OTHER PUBLICATIONS

United States Patent and Trademark Office, Non-Final Office Action dated Jan. 11, 2019 for U.S. Appl. No. 15/934,762, 32 pages.

(Continued)

*Primary Examiner* — Kareen K Thomas
(74) *Attorney, Agent, or Firm* — Jeffrey G. Sheldon; Kathrine B. Sales; Cislo & Thomas LLP

(57) ABSTRACT

A refuse container locking apparatus and method. In some embodiments, the refuse container has a container bin with a container lid rotatably mounted adjacent the open end of the container bin. Some instances of the locking apparatus have a locking hasp arm with a slotted end mounted to a base plate mounted to the container sidewall. The locking hasp is linearly slidable on the base plate between a first arm distal position spaced from container lid and a first arm interlocking position adjacent the container lid. Some instances include a locking bolt mounted on a bolt base mounted on the container lid. The locking bolt is linearly slidable on the bolt base between an unlocked position spaced from the locking hasp arm and an interlocked position adjacent the container lid and in interlocking communication with the locking hasp arm. Some methods can require two hands to operate the locking apparatus.

17 Claims, 21 Drawing Sheets

(56) References Cited

U.S. PATENT DOCUMENTS

| | | | | |
|---|---|---|---|---|
| 2,100,622 | A | 11/1937 | Adams | |
| 2,620,213 | A | 12/1952 | Keeler | |
| 2,701,734 | A | 2/1955 | Grossman | |
| 2,751,240 | A | 6/1956 | Claud-Mantle | |
| 2,955,861 | A | 10/1960 | Claud-Mantle | |
| 3,141,692 | A | 7/1964 | Behrens | |
| 4,021,063 | A | 5/1977 | Porter | |
| 4,121,863 | A | 10/1978 | Lawrence | |
| 4,198,087 | A | 4/1980 | Cornell et al. | |
| 4,690,445 | A | 9/1987 | Hartley | |
| 4,746,152 | A | 5/1988 | Willcox | |
| 4,867,491 | A | 9/1989 | Arnold | |
| 4,884,421 | A | 12/1989 | Lindsay | |
| 5,135,129 | A | 8/1992 | Joly | |
| 5,352,001 | A | 10/1994 | Shieh | |
| 5,970,756 | A | 10/1999 | Miller et al. | |
| 6,880,717 | B1 * | 4/2005 | O'Conor | B65F 1/1615 220/315 |
| 7,798,544 | B1 | 9/2010 | Bates | |
| 8,083,088 | B1 | 12/2011 | Thompson et al. | |
| 8,408,607 | B2 | 4/2013 | Michael et al. | |
| 9,371,673 | B2 | 6/2016 | Nichol | |
| 2006/0169696 | A1 * | 8/2006 | Taylor | B65D 55/16 220/326 |
| 2007/0090114 | A1 * | 4/2007 | Rouns | B65F 1/1615 220/326 |
| 2009/0218829 | A1 | 9/2009 | Stephens et al. | |
| 2015/0090719 | A1 | 4/2015 | Lyon | |
| 2016/0230431 | A1 | 8/2016 | Yonekura | |
| 2017/0043950 | A1 | 2/2017 | Reeb et al. | |
| 2017/0320667 | A1 | 11/2017 | Stone | |

FOREIGN PATENT DOCUMENTS

| | | | |
|---|---|---|---|
| FR | 2072522 | A5 | 9/1971 |
| GB | 191009887 | | 7/1910 |
| GB | 2533716 | | 6/2016 |

OTHER PUBLICATIONS

HardwareHut DEL-7FBR3, Deltana Solid Brass 7-1/16" (179mm), Flush Solt Round Edge—Polished Brass)—www.thehardwarehut.com.

Tower Bolt Slide Door Lock 150Mm Polished Brass With Screws—www.amazon.com.

Zoo Architectural Hardware ZAB100B—150MM Surface Bolt—www.zoohardware.co.uk.

Ironmongery Direct Slide Action Flush Bolt—150 × 25mm—Polished Chrome—www.ironmongerydirect.co.uk.

Defender Security U 9961 4-Inch Surface Bolt, Solid Brass, Polished Brass Finish—Barrel Bolts—Amazon.com.

www.thegrowlercan.com; The Animal Proof Garbage Can; Bear Resistant Storage Containers; Growler Can Official Website;2011.

Kodiak Products; Latch opening instructions;www.kodiak-products.com; Nov. 16, 2015.

Kodiak products 95-info-sheet; Fully automated bear resistant container. Tested with Grizzly bears.; Model No. KP95-HD.

* cited by examiner

REFUSE CONTAINER LOCKING APPARATUS AND METHOD

CROSS-REFERENCE TO RELATED APPLICATIONS

This application claims priority through, and incorporates by reference, the applicant's prior U.S. provisional patent applications as follows: (i) Ser. No. 62/592,274, filed Nov. 29, 2017, entitled "Container Locking Apparatus and Method"; and (ii) Ser. No. 62/598,361, filed Dec. 13, 2017, entitled "Expanded Container Locking Apparatus and Method." In the event of any inconsistency between any such prior application and this application, this application shall govern.

FIELD OF TECHNOLOGY

This application relates to refuse container locking apparatus and methods, and in some embodiments relates to locking apparatus for use with conventional refuse containers having a container bin and a container lid rotatably mounted to the container bin.

BRIEF BACKGROUND OF SOME ASPECTS OF THIS SPECIFICATION

Animal invasion of refuse containers has long been a serious problem. As a result, there have been a great many attempts to solve the problem by trying to make refuse containers difficult or impossible for animals to open.

One dominant type of refuse container is particularly economical, durable, easy to store within a garage or adjacent a garage or other building, and easy to move (via included wheels) toward a street for manual or machine lifting of the container and dumping of its contents into a waste hauling truck. This type of refuse container typically has a plastic refuse bin with a plastic lid rotatably mounted to one side of the bin. An example of such a prior art container is shown in FIG. 1.

Because these types of refuse containers often must be capable of being (i) lifted manually or by one or more arms mounted to waste hauling truck, (ii) emptied by tilting of the container to cause its lid to open, and (iii) closed and returned to the street-side location, the lid of the containers typically must be free to rotate to an open position when the containers are set out to await emptying by a truck. This means that, while the containers sit waiting to be emptied, their openable lid is readily openable by animals, such as bears, coyotes, and others that can either open the container by merely rotating the lid to an open position or by knocking the container over and thus causing the lid to open or be readily opened by the animal.

One substantial solution to the problem of animal tampering is to store the refuse container in a building, such as a garage, at least until the morning of the day of trash pickup. This procedure, however, can be inconvenient for people who would much rather place the refuse container out some time the day prior to pickup or who would like to store the refuse container outside and exposed to possible access by animals.

There have been attempts to provide "animal-proofing" locking mechanisms for such containers. They have typically been one or more among cumbersome, complex, unreliable, and costly. See, e.g., U.S. Pat. Nos. 4,198,087, 8,0983,088, 8,408,607 and U.S. Patent Application Publication Nos. 2017/0043950, 2017/0320667.

A very simple apparatus for trying to animal proof such a refuse container is disclosed in U.S. Patent Application Publication No. 2015/0090719. This apparatus consists of two U-bolts, with one mounted to the container bin sidewall and the other to the container lid, and a snaplock removably securable to each U-bolt spaced from the external periphery of the container.

One problem with this type of apparatus, however, is that the snaplock can be easily grasped by a strong animal and ripped off the plastic container. Even if not pulled off, the applicant believes that smarter animals, such as bears, will eventually figure out how to unlock the snaplock, or unknowingly unlock it, by merely pushing and pulling on the snaplock.

Further, the disclosed snaplock embodiments require that there must be sufficient play in the apparatus components to be able to move the snaplock vertically, to remove it from a U-bolt. (See FIGS. 3-6.) This means that the container lid is not secured to the upper edge of the container bin and can be easily separated from the bin upper edge—including by merely knocking over the container—to allow either dumping of contents through the semi-opened area or grasping of the semi-opened lid, such as by a bear, to bend the lid or rip it off the container bin.

BRIEF SUMMARY OF SOME ASPECTS OF THIS SPECIFICATION

The applicant believes he has discovered at least some of the issues, and their severity, set forth the Background supra. The applicant has therefore invented a relatively less complex apparatus for animal proofing or securing a refuse container by maintaining a lid in a closed position on a mating refuse container when desired.

In some embodiments, the apparatus provides two locking arm apparatus, with one mounted on the container lid and the other on the container bin. One or both of the locking arm apparatus are linearly slidable to (i) interlock with each other and secure the lid in a closed position on the bin and (ii) unlock and separate from each other, allowing at least a portion of the lid to be moved away the container bin.

In some embodiments, one locking arm apparatus includes a hasp slidably mounted to the bin sidewall. The other locking arm apparatus includes a surface bolt slidably mounted to the lid. In some applications, the hasp is slidably mounted on a hasp base, which in turn can be mounted to the bin sidewall. Similarly, in some instances the surface bolt is slidably mounted to a bolt base, which in turn can be mounted to the lid.

Certain embodiments include biasing of one or more of the locking arm apparatus, such as, in some applications, with a spring secured to a hasp and to the bin sidewall or a hasp base. The biased locking arm apparatus, such as a hasp, can therefore be biased to move in a direction causing the hasp to interlock with the other locking arm apparatus, such as, in some embodiments, a surface bolt.

In some embodiments, the surface bolt has a hasp interlocking slot penetrating the outer surface of the bolt. Interlocking of the bolt and a biased hasp can therefore include (i) moving the upper edge of a bolt slot in the hasp to a position in which the surface bolt can be slid to penetrate the bolt slot in the hasp and (ii) releasing the biased hasp so that the upper edge of the hasp slot slides into the hasp interlocking slot in the bolt. In this position, the surface bolt cannot be retracted from interlocking with the biased hasp to secure the lid in a closed position on the upper edge of the container bin.

In some embodiments in which the container bin and/or container lid has an outer edge extending transversely or otherwise away from the bin sidewall, a hasp passage may be formed in a portion of the outer edge so that the hasp may slide through the hasp passage to interlock with the surface bolt or to unlock and slide away from the surface bolt, such as to a retracted position spaced from the lid.

In certain applications, the container lid is rotatably mounted to a portion of the upper edge of the container bin. In instances employing a biased hasp interlocked to a mating bolt, unlocking of the hasp from the bolt can require using two hands, with one hand causing movement of the hasp with respect to the surface bolt, and the other hand sliding the surface bolt out of the hasp slot. Two hands are similarly required to interlock the biased hasp and mating bolt.

A surface bolt apparatus can include two components such as a surface bolt slidably mounted to a rigid base. The bolt base can have opposed bolt channels and a bolt sliding surface intermediate the opposed ridges. The opposed bolt channels and intermediate sliding surface can cooperatively provide a bolt sliding channel through which the bolt can be slid. One advantageous embodiment of the surface bolt apparatus includes a surface bolt made of metal and a base made of plastic.

In some embodiments providing a hasp assembly with a hasp slidably mounted to hasp base, the hasp base can have opposed hasp channels and a hasp sliding surface intermediate the opposed ridges. The opposed hasp channels and intermediate sliding surface can cooperatively provide a hasp sliding channel through which the hasp can be slid. The hasp assembly can including biasing structure, such as a spring, to bias the hasp to slide (in the depicted embodiments, downwardly with respect to a container lid for example). In some advantageous embodiments of such a hasp assembly, the hasp and hasp base can be molded of a strong material, such as a strong plastic, and the spring is made of resilient metal.

Some embodiments of the interlocking apparatus and include a hasp apparatus housing surrounding the hasp apparatus when in the fully retracted position. The hasp apparatus housing can render more aesthetically pleasing the container on which the interlocking apparatus is mounted. The housing can also prevent contact with these components, such as with a person or an animal, to the degree that the hasp apparatus is surrounded by the housing.

Some embodiments of the interlocking apparatus can be one or more of easy to make, package, ship, and mount on a mating refuse container. Certain instances can be, in addition or in the alternative, one or more of easy to use, lightweight, strong, durable, economical, and easy to remove from a refuse container, repair, and/or replace.

This specification also includes novel surface bolt apparatus. In some applications, the surface bolt apparatus can include a bolt slidable within an bolt channel in a bolt base, with the bolt base securable to another structure (such as a refuse container as but one example) by one or more fasteners or other fastening structure or composition. In some embodiments, one or both of the bolt and the bolt base may be made of a lightweight material such as a strong plastic.

Some methods of use can include locating the refuse container in a position exposed to animals that may seek to access the contents of the refuse container. In such a position, some embodiments of the interlocking apparatus can require use of two hands to (i) secure the container lid in a closed position on the container bin and/or (ii) disconnect the interlocking apparatus to rotate the container lid to an open position and access the contents of the refuse container. In some applications, the user can thus place the refuse container outside long before refuse collection takes place (such as the night before for example), easily and reliably securing the lid to the container bin when so positioned, and then easily unlock or have unlocked the interlocking apparatus the next morning or up to just before the waste hauler lifts the refuse container to dump its contents into a waste hauling truck.

There are many other novel features and aspects of the present specification. They will become apparent as the specification proceeds. It is therefore to be understood that the scope of the invention is to be determined by the claims as issued and not by whether any given subject matter includes an aspect because it is recited in the Brief Background section supra or this Brief Summary section.

BRIEF DESCRIPTION OF THE DRAWINGS

The inventor's preferred and other embodiments are disclosed in association with the accompanying drawings, in which.

DETAILED DESCRIPTION

The prior Brief Summary and the following description provide examples that are not limiting of the scope of this specification. One skilled in the art would recognize that changes can be made in the function and arrangement of elements discussed without departing from the spirit and scope of the disclosure. Various embodiments can omit, substitute, add, or mix and match various disclosed components or procedures as desired.

Figure 1:
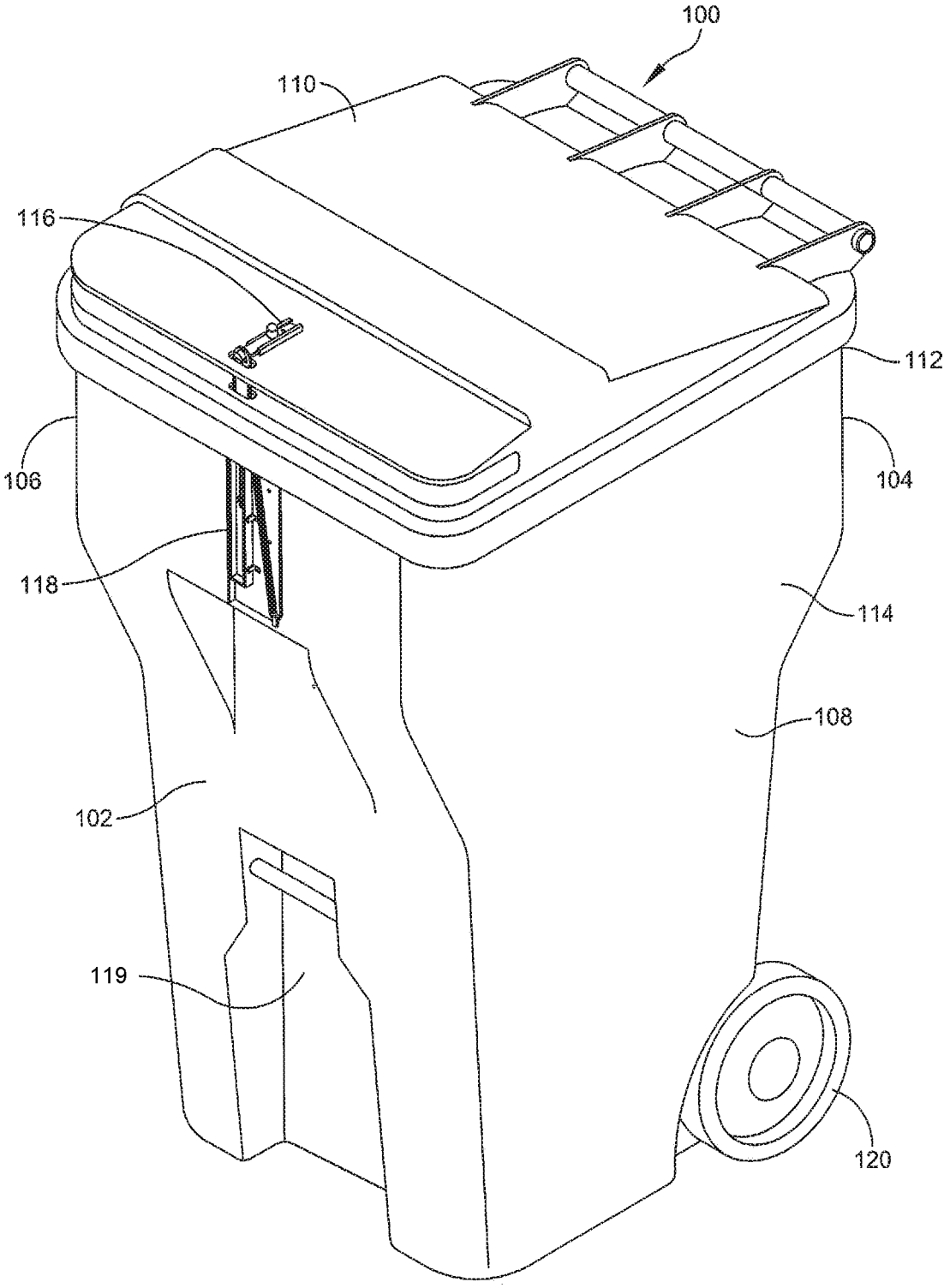
FIG. 1 is a perspective view of an embodiment of a common refuse container having an interlocking slidable-hasp-and-surface-bolt system for locking the lid in a closed position on the upper edge of a container bin.

With reference now to FIG. 1, an approximately 32-35 gallon lockable refuse container, generally 100, has a (i) front side 102 opposite a backside 104, (ii) a left side 106 opposite a right side 108 extending from the front side 102 to the backside 104, (iii) a container lid 110 rotatably mounted about the upper end 112 of the backside 104 a container bin 114, (iv) a first interlocking apparatus 116 mounted to the container lid 110, and (v) a second interlocking apparatus 118 mounted to the container bin 114 interlocked to the first interlocking apparatus. 116. In some embodiments, the refuse container bin 114 may include a lifting arm channel 119 penetrable by a container lifting arm (not shown) of a refuse hauling truck (not shown) in order to lift and dump refuse from the refuse container 100 into the refuse hauling truck. The refuse container 100 may also include wheels, e.g., 120, so that the refuse container 100 may be moved from one location (not shown) to another (not shown).

Figure 2:
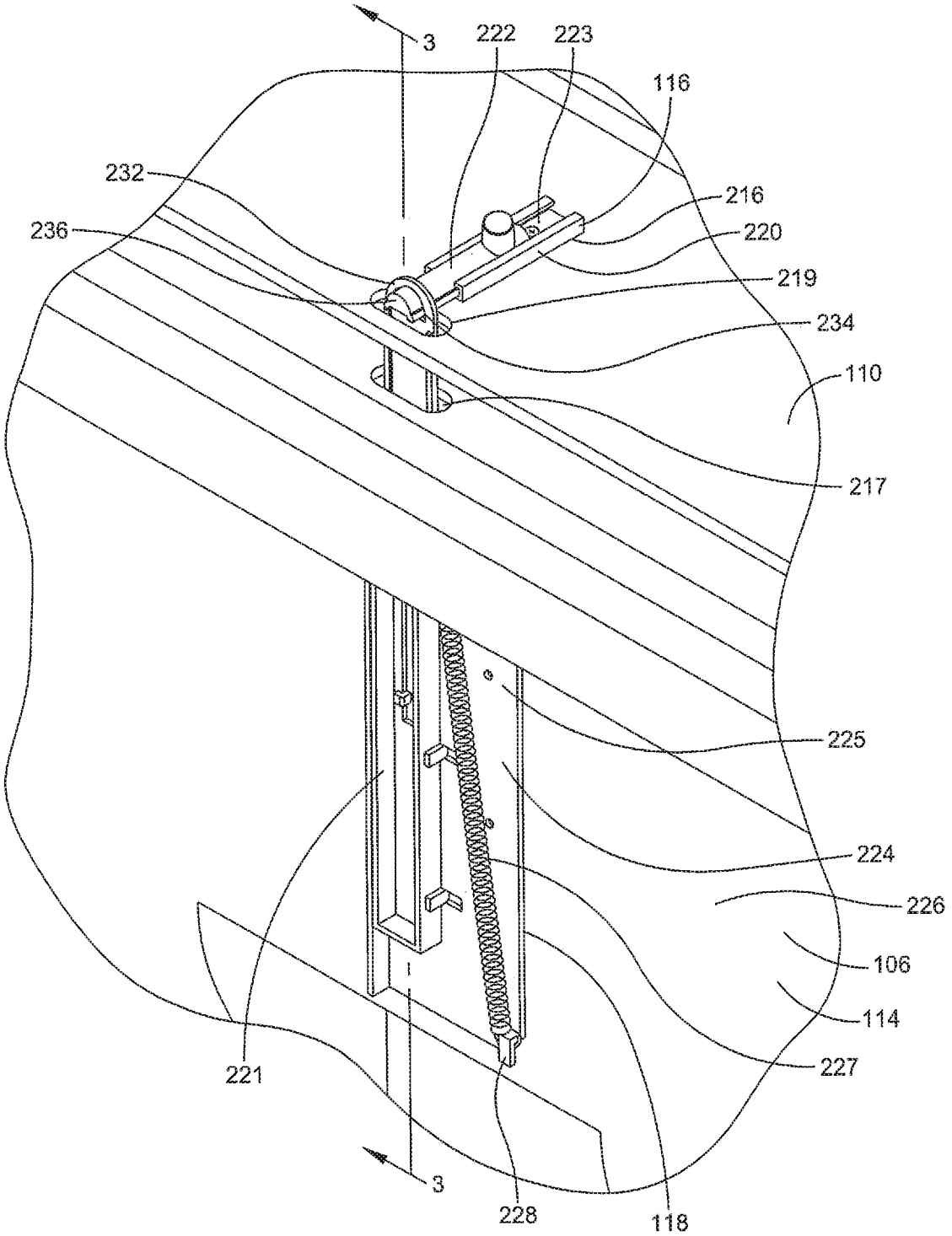
FIG. 2 is a partial perspective view of the refuse container of FIG. 1 showing an expanded view of the interlocking slidable-hasp-and-surface-bolt system and associated refuse container structure of FIG. 1.

With reference now to FIG. 2, the container lid 110 is locked in a closed position to abut an upper edge (not shown in FIG. 1) of the container bin 114. In this position, the second interlocking apparatus 118 penetrates several passages 217, 219 in the container lid 110 as well as another hasp passage in the upper end of the container bin (not shown in FIG. 1) to interlock with first interlocking apparatus 116.

In this regard, one embodiment of the first interlocking apparatus 116 is a surface bolt apparatus 216. The surface bolt apparatus 216 has (i) a laterally extending bolt base 220 secured to the container lid 110, and (ii) a bolt 222 slidably mounted within a laterally extending bolt channel 223 in the bolt base 220.

One embodiment of the second interlocking apparatus 118 has a laterally extending hasp 221 slidably mounted to a hasp base plate 224, which is mounted to abut the outer surface 226 of the container bin 114 and held in position at that location by fasteners, such as rivets, e.g., 225, penetrating the bolt base 220 and front side 102 of the container bin 114. The hasp 221 is biased away from the container lid 110 by a spring 227 attached an one, lower end 228 to the base plate 224 and at another, upper end 230 (not shown in FIG. 2) to the hasp 221.

The upper working end 232 of the hasp 221 includes a bolt slot 234. In the hasp 221/bolt 222 interlocked position shown in FIG. 2, the slidable working end 236 of the bolt 222 penetrates the bolt slot 234 in the hasp 221, and the hasp 221 is biased downwardly into interlocking contact with the slidable working end 236 of the bolt 222.

Figure 3:
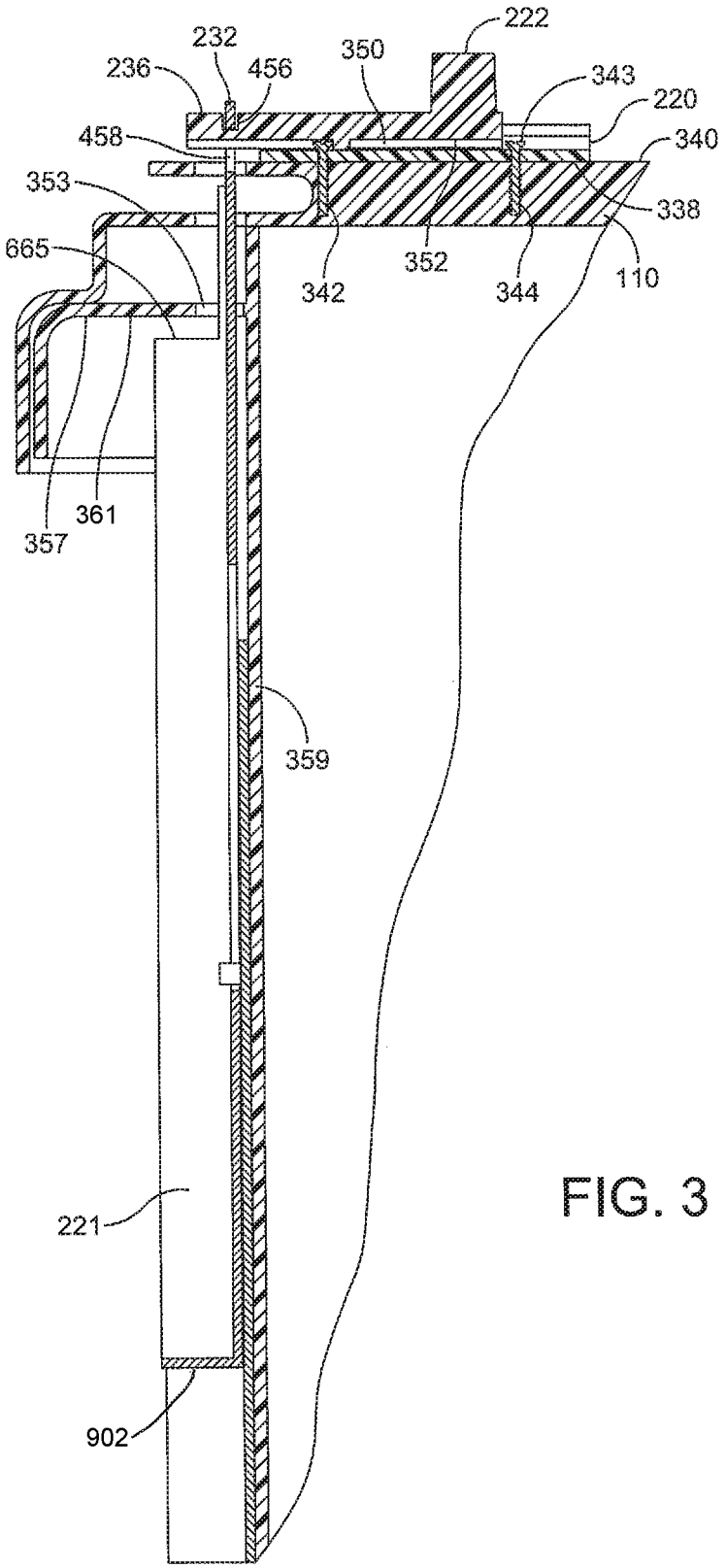
FIG. 3 is a cross-sectional view taken along section line 3-3 of FIG. 2.

Referring now to FIG. 3, the bolt base 220 has a planar bottom section, e.g., 338, abutting a generally planar upper side 340 of the lid 110. The bolt base 220 is secured in position on the container lid 110 by two screw fasteners 342, 344 penetrating the bolt base 120 and the container lid 110; and each such screw fastener, e.g., 342, has a screw head 343 extending from the container lid's upper surface 340 into a fastener channel 350 extending along the laterally extending underside 352 of the bolt 222.

Figure 4:
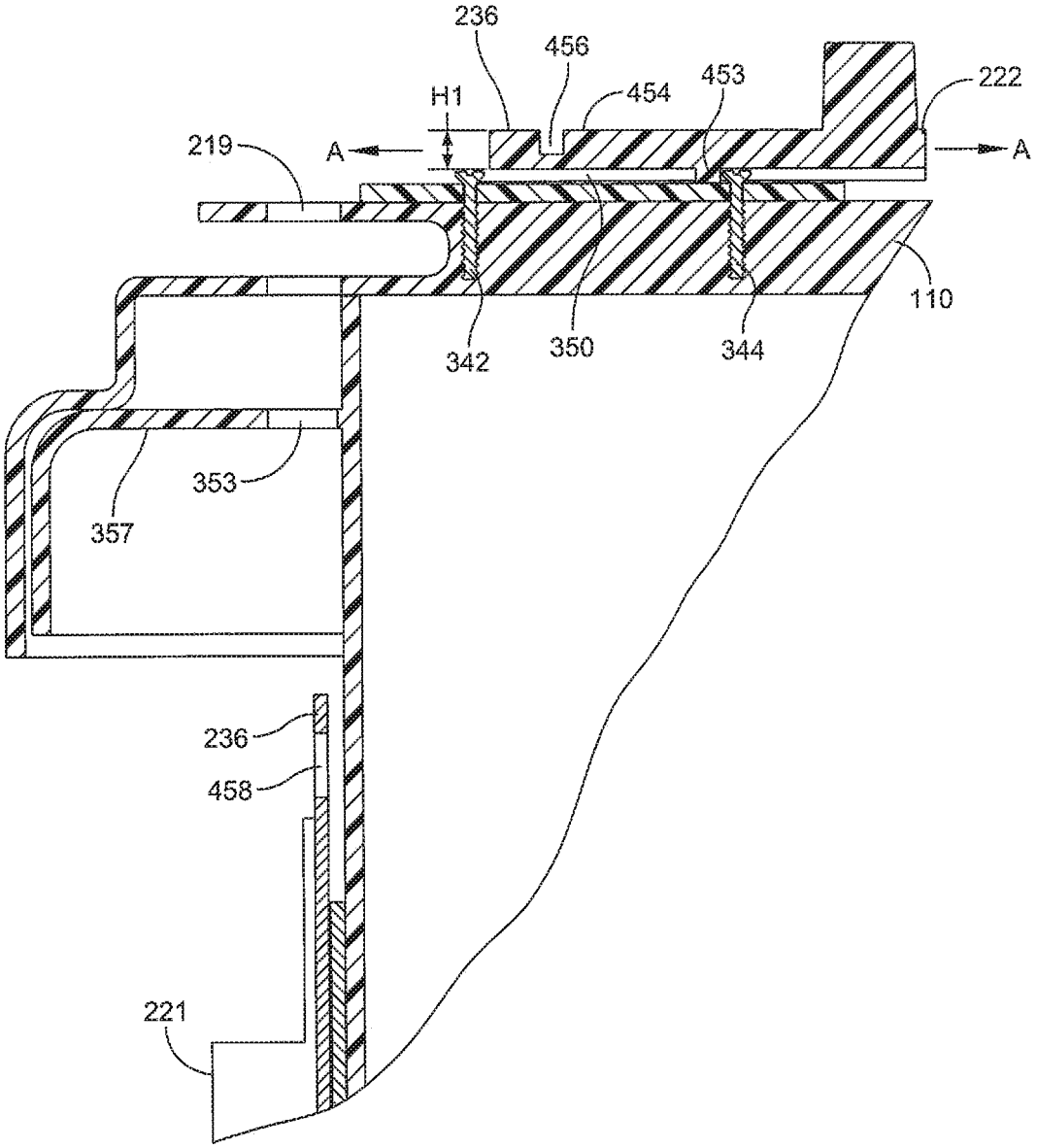
FIG. 4 is partial cross-sectional of a portion of FIG. 3 showing a further expanded cross-sectional view of slidable-hasp-and-surface-bolt system and associated refuse container structure of FIG. 3 but with the hasp and bolt retracted from the interlocked position of FIG. 3.

Referring now to FIG. 4, a bolt stop 453 extends from the underside 352 of the bolt 222 to also penetrate the fastener channel 350 in the bolt's underside 352. The bolt stop 453 and the entire unitary bolt 222 are thus constrained by the opposed screw fasteners 342, 344 to lateral, sliding movement of the bolt stop 453 between the screw fasteners 342, 344 within the fastener channel 350 in the underside 352 of the bolt 222.

The upper surface 454 of the working end 236 of the bolt 222 has a hasp slot 456 transverse to the axis A-A of the bolt 222. Similarly, the working end 232 of the hasp 221 has a bolt slot or channel 458 transverse to axis A-A of the bolt 222.

Figure 5:
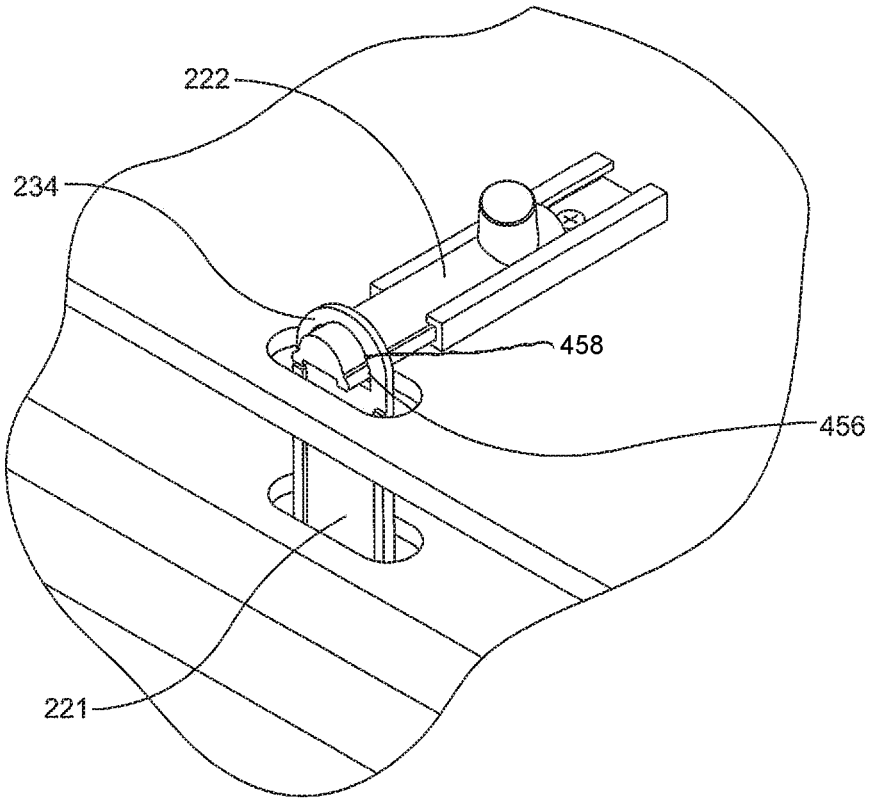
FIG. 5 is partial, enlarged perspective view of the interlocking slidable-hasp-and surface-bolt system of FIG. 1.

With reference back to FIG. 3, in the hasp 221/bolt 222 interlocked position depicted in FIG. 3, the working end 236 of the bolt 222 penetrates the bolt slot 458 in the hasp 221, and the upper working end 232 of the hasp 221 penetrates the hasp slot 456 in the bolt 222. In addition, the working upper end 232 of the hasp 221 also extends through a hasp passage 353 in a bin lip 357 extending outwardly from the central body section 359 in the container bin 114. Further, as shown in FIGS. 3 and 5, due to the biasing of the hasp 221 downwardly away from the container lid 110 by the hasp apparatus spring 227 (not shown in FIGS. 3 and 5), the working upper end 232 of the hasp 221 is similarly biased by hasp apparatus spring 227 to penetrate the hasp slot 456 and prevent movement of the working end 236 of the bolt 222 out of the bolt slot 458 in the hasp 221.

Figure 6:
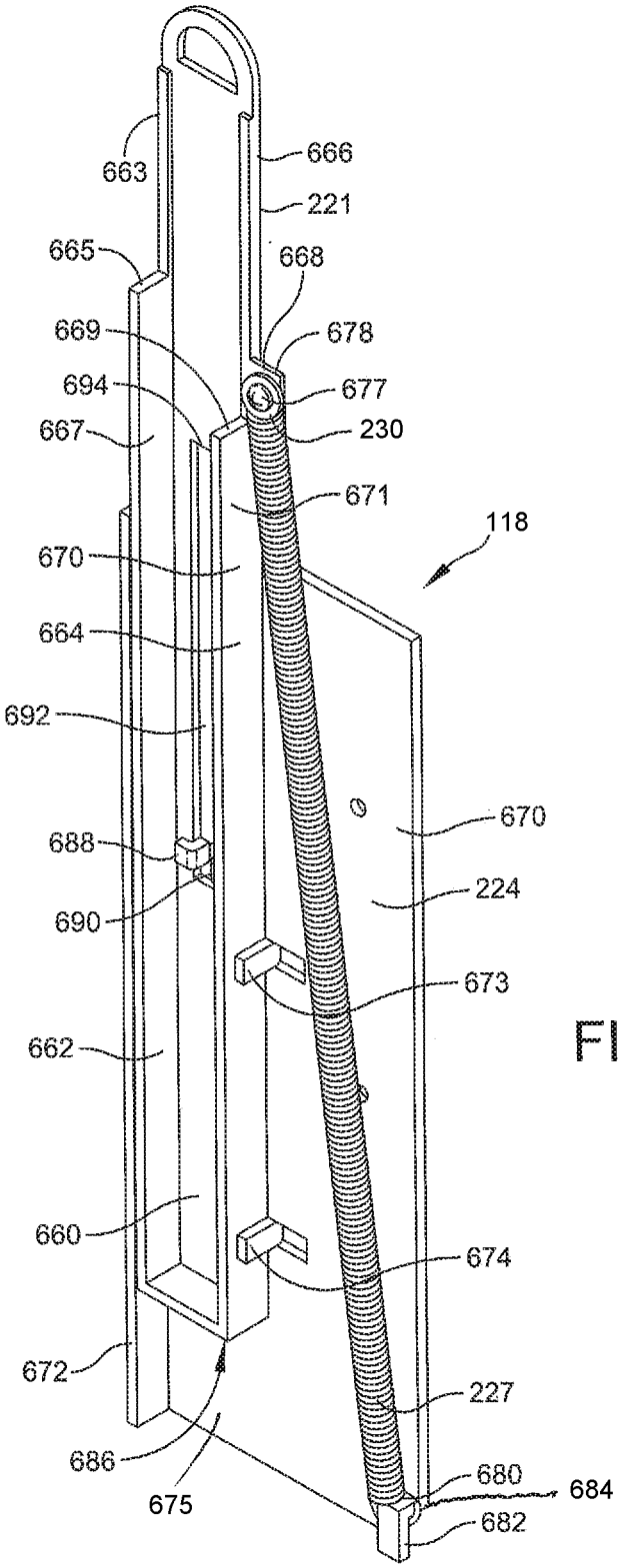
FIG. 6 is a perspective extended hasp view of the slidable hasp apparatus of FIG. 1.
Figure 7:
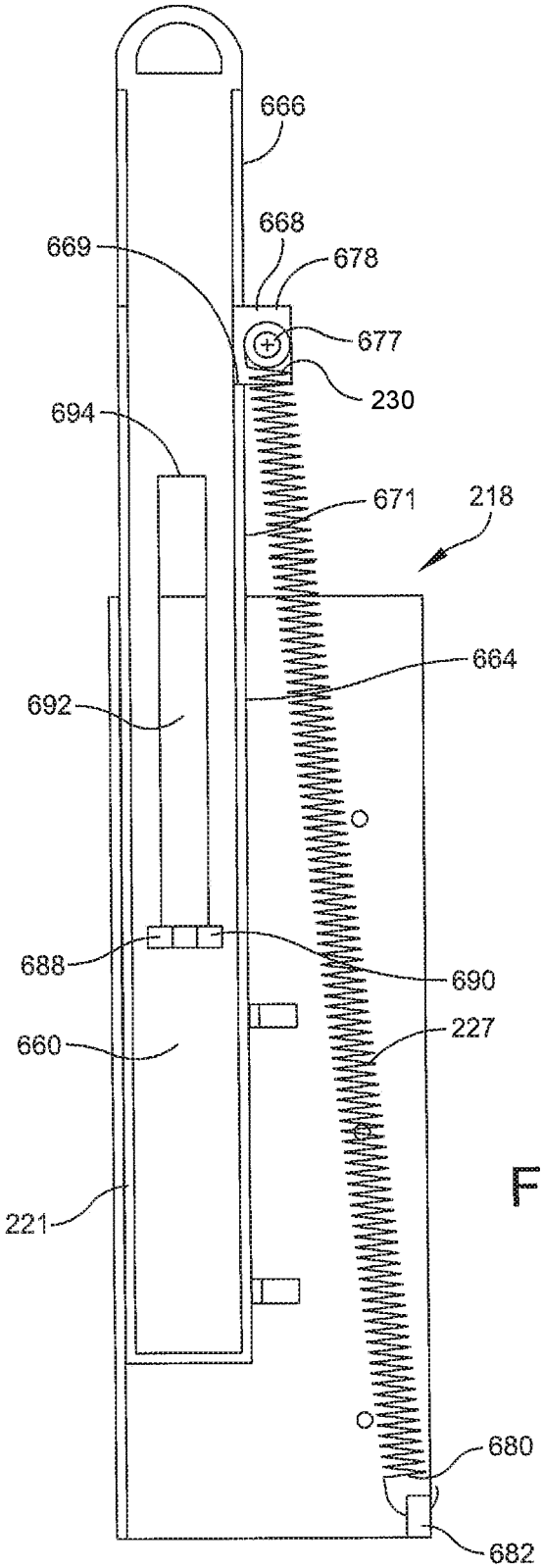
FIG. 7 is an elevational view of the slidable hasp apparatus of FIG. 6.

Referring now to FIGS. 6 and 7, the hasp 221 in the hasp interlocking apparatus 118 has a generally planar central section 660 intermediate opposed, laterally-extending planar sides 662, 664 also extending transversely from the central section 660. The left laterally-extending side 662 has a narrowed end 663 terminating in a left side neck-stop 665: (i) extending transverse to the plane of the central section 660; and (ii) providing the upper edge 665 of a widened planar side section 667. The right laterally-extending side 664 has a narrowed end 666 terminating in a right side neck-stop 668 at the upper edge 665 of an upper spring mount tab 678: (i) extending parallel to the plane of the central section 660; (ii) transverse to the upper edge 669 of a widened planar side section 671. Referring back to FIG. 3, the co-planar neck-neck stops, e.g., 665, can limit upward movement of the working upper end 232 of the hasp 221 when the neck-stops, e.g., 665, are raised sufficiently to abut the underside 361 of the bin lip 357.

Referring back to FIG. 6, the hasp apparatus base plate 224 has a generally planar, rectangular central section 670. A laterally extending, planar, rectangular hasp retainer side 672 extends transversely from the central section 670, and two outer hasp retaining tabs 673, 674 also extend transversely from the central section 670 spaced from the opposed hasp retainer side 672. The hasp 221 is secured in a slidable position along the outer surface 675 of the hasp base plate 224 intermediate and abutting: (ii) the base plate's laterally extending retainer side 672 abutting the left laterally extending side 662 of the hasp 221; and (ii) the two spaced-apart hasp retaining tabs 673, 674 abutting the opposed laterally extending side 664 of the hasp 221.

The hasp base plate 224 is more than twice as wide as the hasp 221. In one embodiment, the upper end 230 of spring 227 is attached by a fastener 677 to an upper spring mounting tab 678 that extends from the narrowed end 666 in the right side 664 of the hasp 221 (see also FIG. 7), and the lower end 680 of the spring 227 is attached to a lower L-shaped spring mounting tab 682 extending from the lower corner 684 of the hasp base plate 224 distal from the lower end 686 of the hasp 221. Alternatively, the upper end 230 of the spring 227 may be attached to the upper spring mounting tab 678 by merely inserting an upwardly curled upper end of the spring 227 through a mating spring mounting passage in the center of the upper spring mounting tab 678.

A pair of spaced-apart L-shaped hasp slot guide tabs 688, 690 also extend from the base plate 224 and penetrate a laterally extending hasp guide slot 692 along the axial center of the central section 660 of the hasp 221 (see also FIG. 7). Note that, during hasp apparatus assembly, these hasp slot guide tabs 688, 690 are initially straight and parallel to each other, not L-shaped. The L-shape is formed after mounting the hasp 221 to the base plate 224, so that the L-shape can then be formed by bending free ends of the hasp slot guide tabs 688, 690 away from the hasp guide slot 692. After being so bent, then, in cooperation with hasp retainer side 672 and the opposed outer hasp retaining tabs 673, 674, the L-shaped hasp slot guide tabs 688, 690 thereby constrain the hasp 221 to lateral sliding movement along the lateral length of the hasp guide slot 692, while the spring 227 biases the hasp guide slot 692 and hasp 221 (shown in the maximum upwardly extended hasp position in FIG. 6) downwardly with respect to the hasp slot guide tabs 688, 690 toward restraining contact with the upper end 694 of the hasp guide slot 692.

Figure 8:
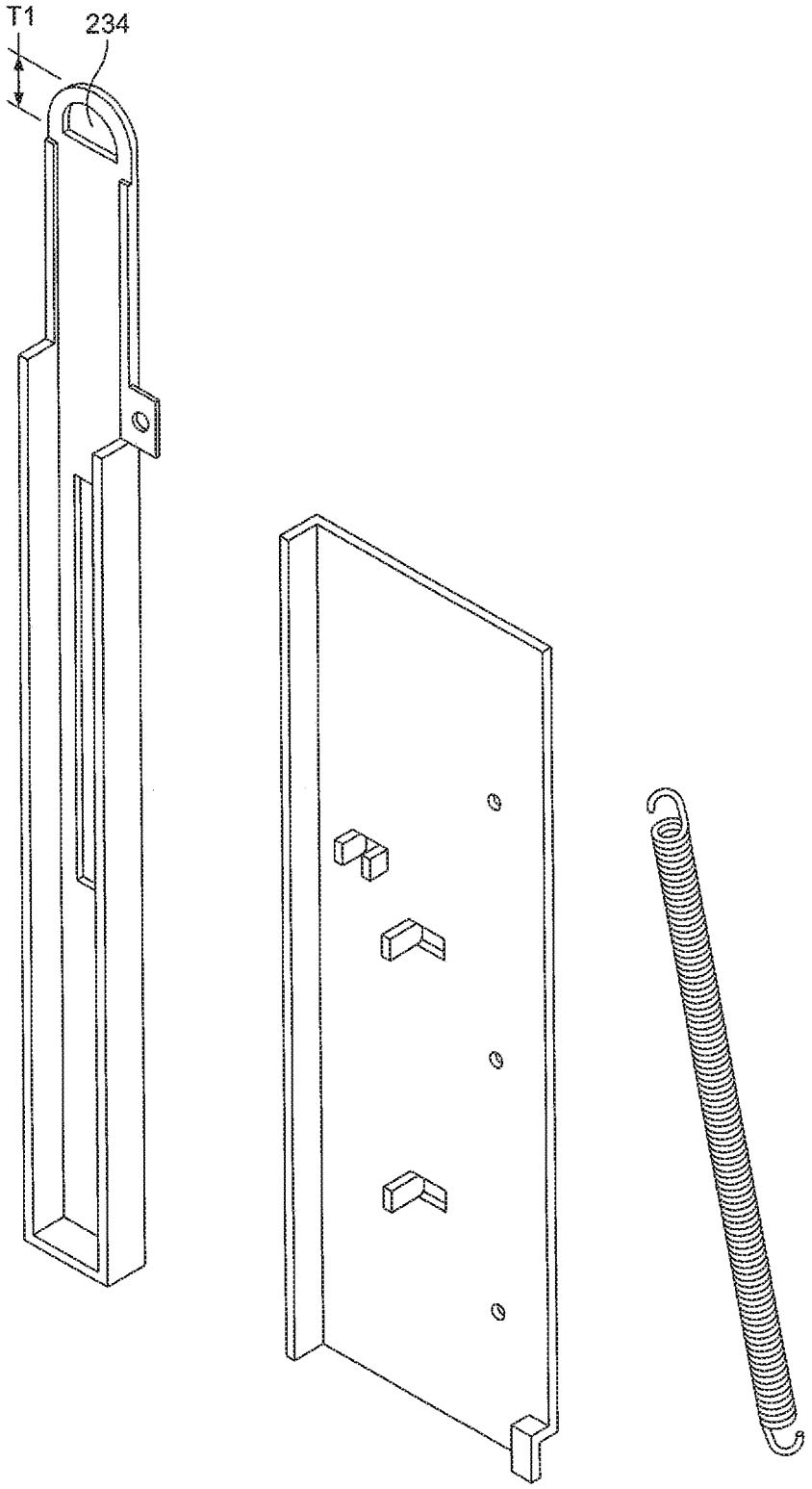
FIG. 8 is an exploded perspective view of the slidable hasp apparatus of FIG. 6.
Figure 9:
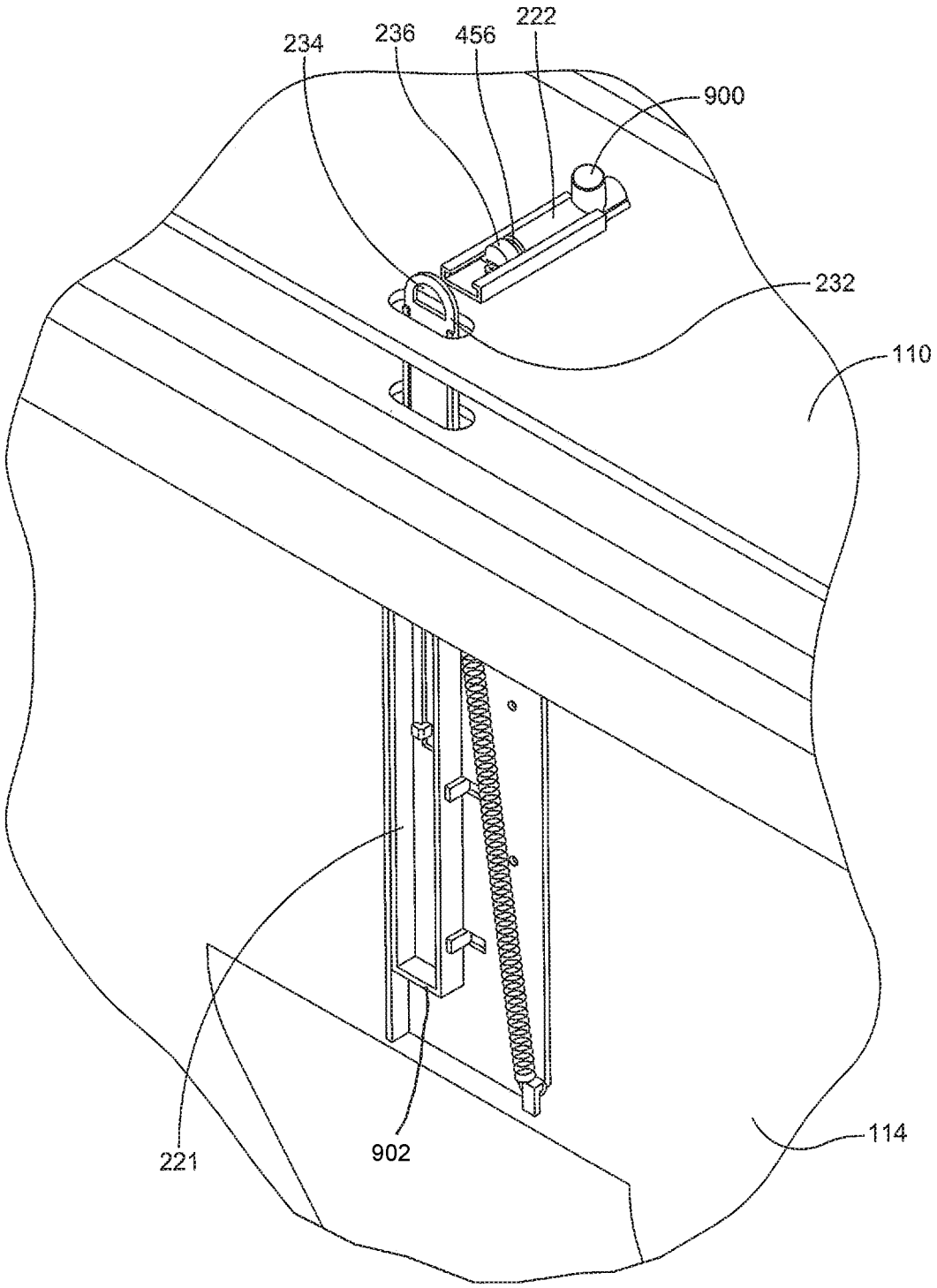
FIG. 9 is an enlarged partial perspective view of the slidable-hasp-and surface-bolt system of FIG. 1 but with the hasp slid upward with respect to the surface bolt and the surface bolt slid rearward and out of a bolt slot in the hasp.

With reference now to FIG. 8, the bolt slot 234 in the hasp 221 is D shaped. With reference to FIG. 9, the arc in this D-shape is slightly taller T1 than, as shown in FIG. 4, the height H1 of the somewhat D-shaped working end 236 of the bolt 222. In one embodiment, T1 is 0.05 inches larger than H1.

With reference back to FIG. 6, the resulting hasp apparatus 118 can be relatively compact, easy to make and assemble (including onto a container bin sidewall), and lightweight and compact for shipping. One exemplary embodiment of the hasp apparatus 118 (less any fasteners, such as rivets or screws) is inches 8.64 inches tall by 2 inches wide by 0.60-0.65 inches deep. The hasp 221 and base plate 224 can be made of differing materials (including differing among them), such as metal, other strong plastic, or composite material. The spring is made of a suitable resilient but flexible metal. In one embodiment, all components of the hasp apparatus 218 (less any fasteners that may be added) are made of aluminum, and provide a total weight of approximately 0.20-0.30 lbs.

Referring now to FIG. 9, in the non-interlocked position (allowing the container lid 110 to be rotated away from the closed position on the container bin 114), the bolt 222 will have been slid away from the bolt slot 234 in the hasp 221. With reference now to FIGS. 3 and 9, in order to arrive at this hasp/bolt non-interlocked position of FIG. 9 from the interlocked position of FIG. 3: (i) the hasp 221 is raised by one hand (not shown) such as by lifting the planar hasp bottom end 902 sufficient to raise the upper working end 232 of the hasp 221 out of the hasp slot 456 in the bolt 222; while (ii) the other hand (not shown) grasps the bolt knob 900 and slides the bolt 222 and its working end 236 out of, and distal from, the bolt slot 234 in the hasp 221. Conversely, in order to arrive at the bolt/slot interlocked position of FIG. 3 from the non-interlocked position of FIG. 9: (i) one hand lifts the hasp 221 until the hasp neck-stops, e.g., 663, abut the underside 361 of the container bin lip 357; while (ii) the other hand grasps the bolt knob 900 and slides the bolt 222 from the non-interlocked position of FIG. 9 to (a) with reference to FIG. 3, have the bolt's working end 236 penetrate the bolt slot 234 in the hasp 221 so that the upper working end 232 is aligned directly over the bolt's hasp slot 456 and (b) then release the hasp 221 so that the downwardly biased hasp 221 is pulled downward so that the hasp working end 232 penetrates the hasp slot 456.

Figure 10:
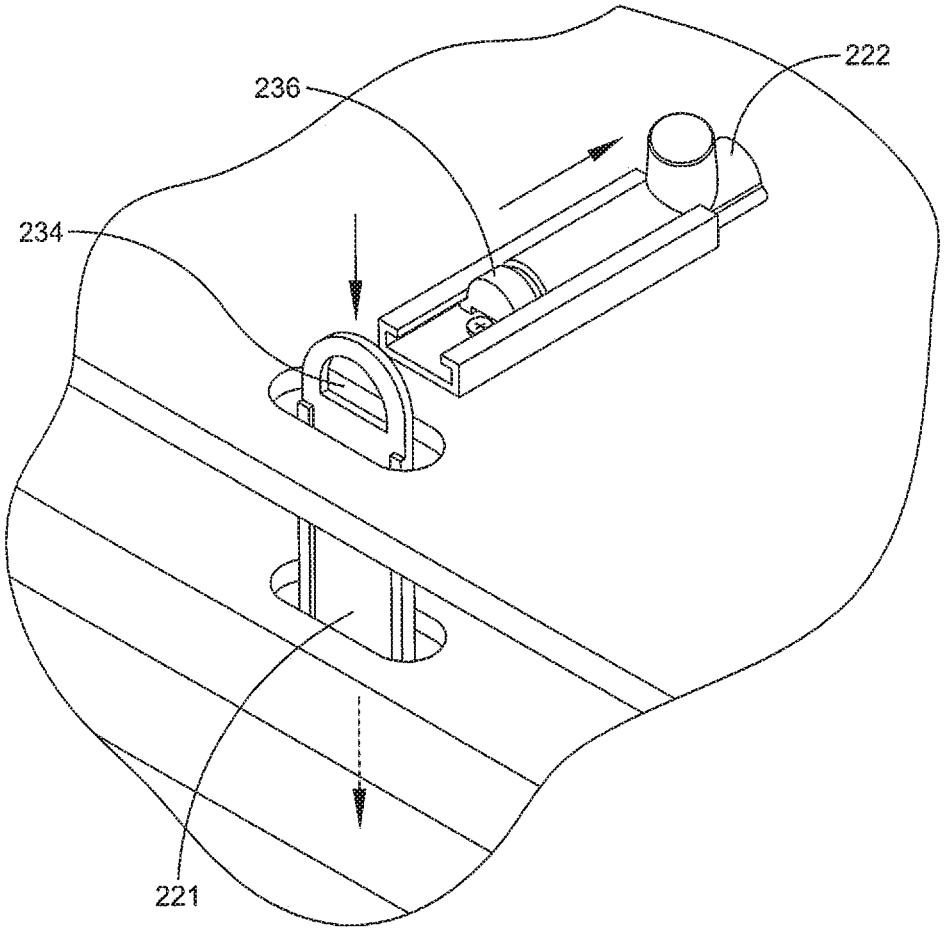
FIG. 10 is a further enlarged view of the non-interlocked slidable-hasp-and surface-bolt system of FIG. 9.
Figure 11:
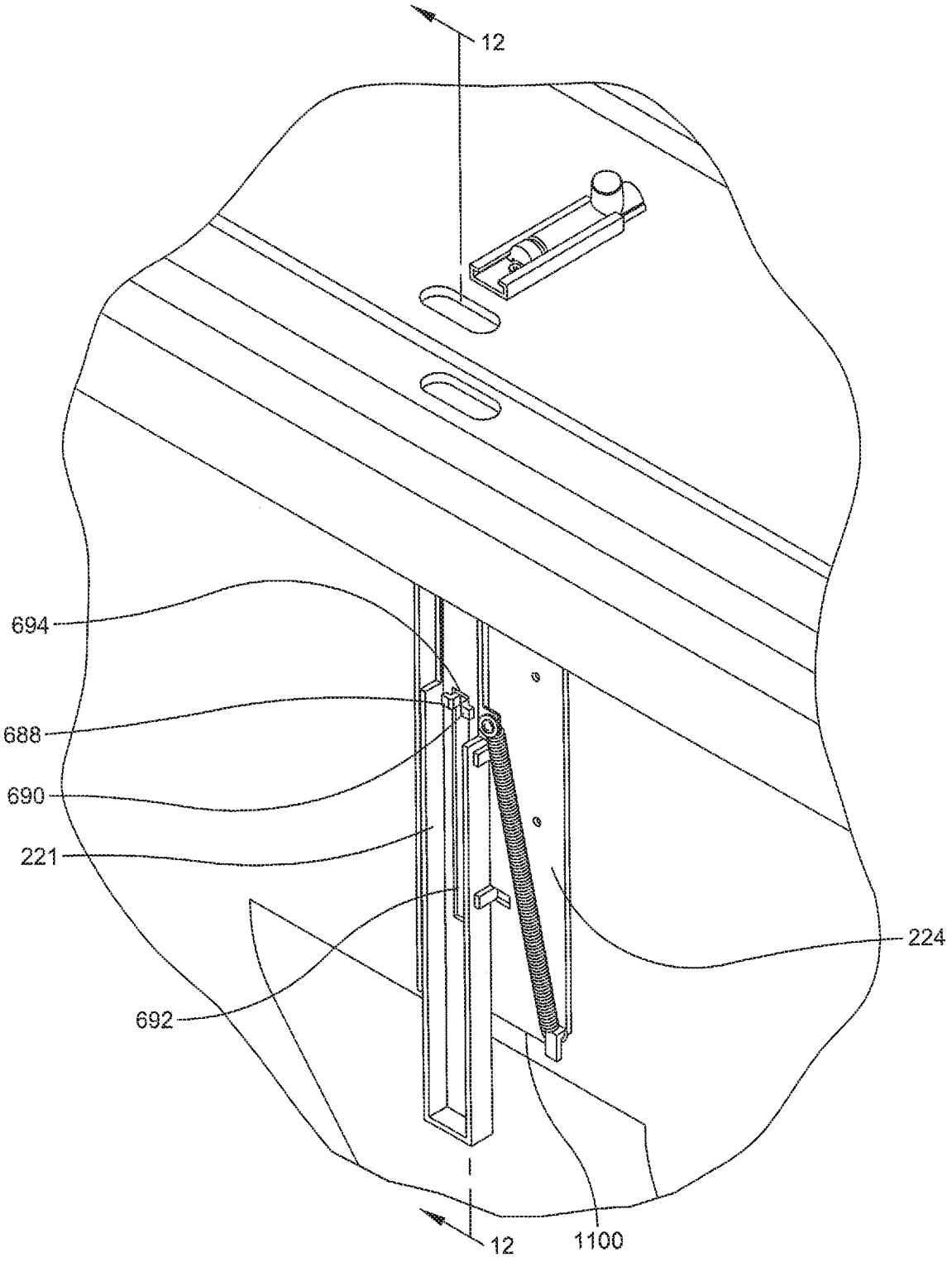
FIG. 11 is an enlarged perspective view of slidable-hasp-and surface-bolt system of FIG. 9 but with the hasp slid downwardly and distal from the surface bolt and container lid.
Figure 12:
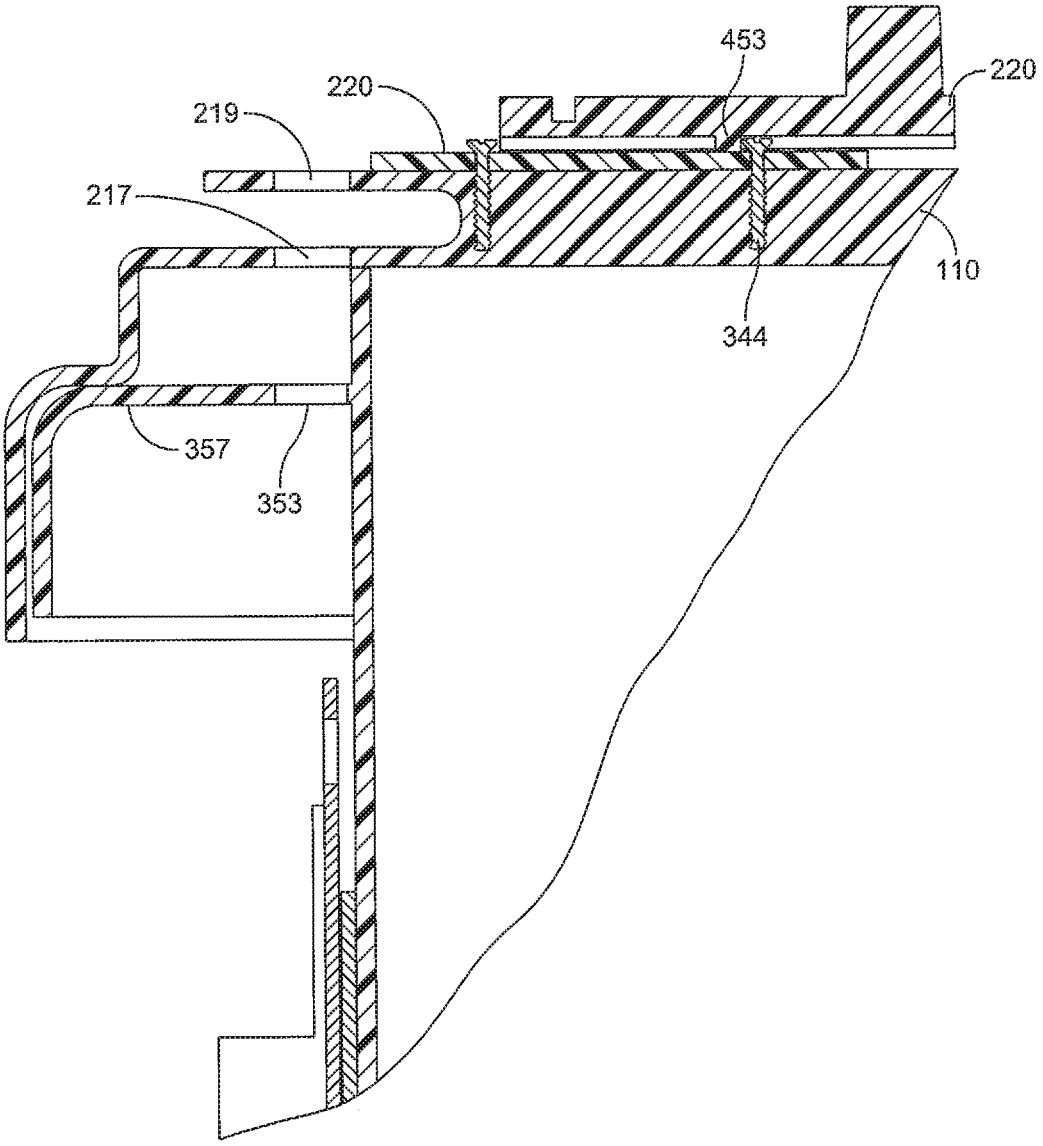
FIG. 12 is a further enlarged partial cross-sectional view taken along section line 12-12 of FIG. 11.
Figure 13:
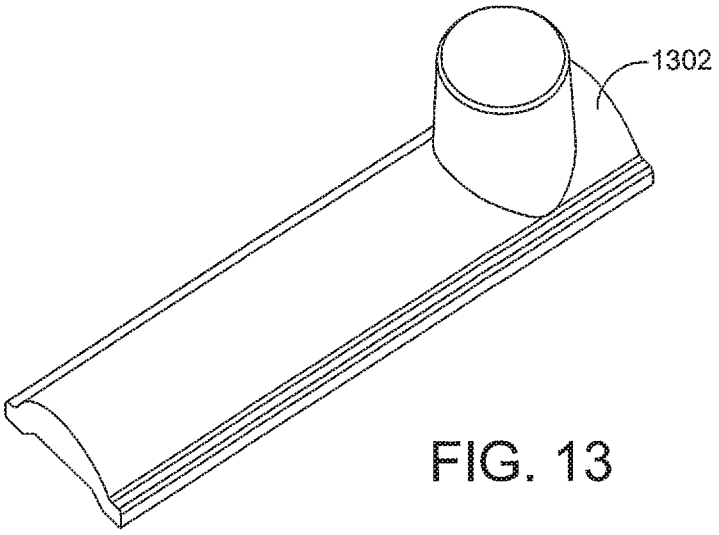
FIG. 13 is perspective view of an alternative slidable surface bolt not having hasp slot as in the surface bolt of FIG. 3.
Figure 14:
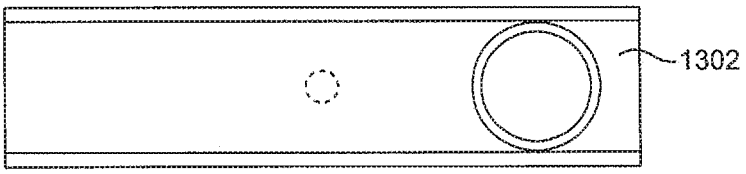
FIG. 14 is a plan view of the slidable surface bolt of FIG. 13.
Figure 15:
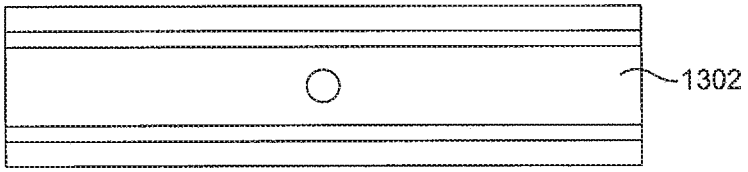
FIG. 15 is a bottom view of the slidable surface bolt of FIG. 13.

With reference now to FIG. 10, when the working end 236 bolt 222 is out of the bolt slot 234 in the hasp 221, the downwardly biased hasp 221 automatically retracts, as shown in FIGS. 11 and 12, downwardly through (i) the aligned hasp passages 217, 219 in the container lid 110 and (ii) through the bin hasp passage 353 in the container bin lip 357, to stop at the fully retracted position of the hasp 221 with respect to the hasp base plate 224 due to the hasp slot guide tabs 688, 690 making contact with the upper end 694 of the guide slot 692 in the hasp 221. Two hands are thus required to either interlock or un-interlock the hasp 221 and bolt 222; and the hasp 221 and bolt 222 cannot be accidentally interlocked or un-interlocked without use of two hands. In addition, the two hands must be in substantially differing locations, each grasping differing interlocking apparatus (the hasp apparatus and the bolt apparatus) and moved very differently with respect to each other, to cause simultaneous and very differing types of sliding movement of the differing interlocking apparatus (i.e., sliding perpendicularly with respect to each other, one on the top of the container lid and the other on side of the container bin). The interlocking apparatus thus also cannot be unlocked by animals unless—possibly—by certain exceptionally intelligent animals extensively trained by humans to do so.

With reference to FIG. 11, note that, if desired lateral length of the hasp 221 can be shortened or lengthened if desired. In one embodiment, the planar lower end 686 of a shortened hasp (not shown) aligns and is coplanar with bottom edge 1100 of the hasp base plate 224 when the hasp is in the fully retracted or lowered position. This latter version, with the shortened hasp, is the applicant's Critter-Foiler™ refuse bin locking system.

With reference to FIG. 12, the movement of the bolt 222 within the bolt base 220 away from the hasp passage 219 in the container lid 110 is limited by the distal fastener 344 (with respect to the hasp passage 219) abutting the bolt stop 453.

Figure 16:
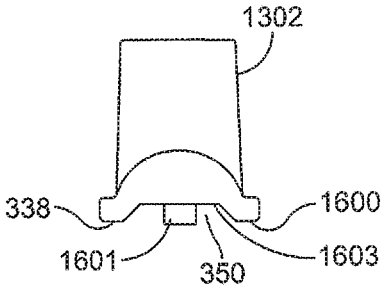
FIG. 16 is an elevational view of the slidable surface bolt of FIG. 13.
Figure 17:
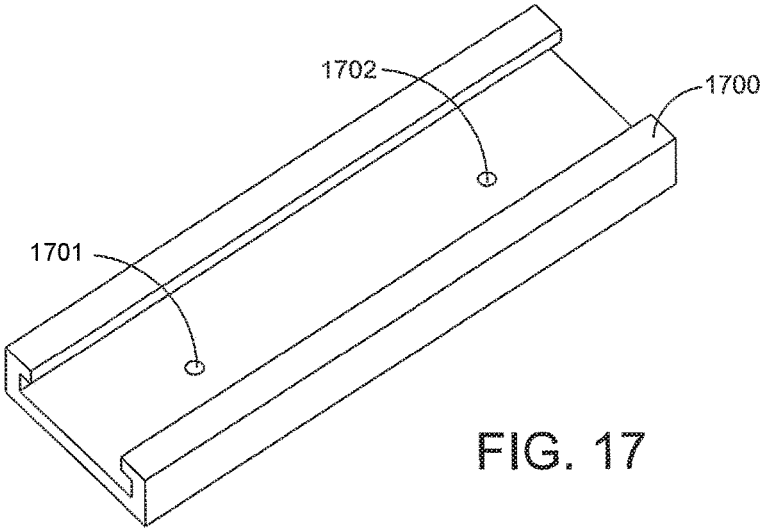
FIG. 17 is a perspective view of a surface bolt base for use with the depicted surface bolts in this specification.
Figure 18:
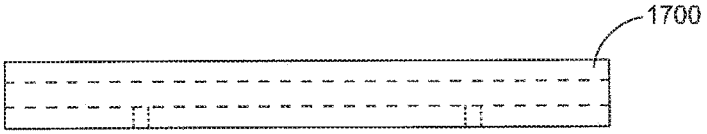
FIG. 18 is a side view of the surface bolt base of FIG. 17.
Figure 19:
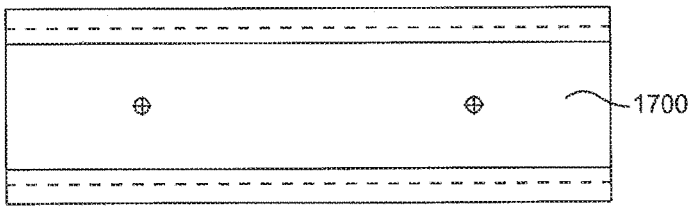
FIG. 19 is a plan view of the surface bolt base of FIG. 17.

Referring next to FIGS. 13-21, an alternative embodiment of the applicant's surface bolt interlocking apparatus also provides both a unique ornamental design as well as novel function described above except for that provided by the hasp slot not included in the alternative bolt 1302. In the bolt apparatus embodiment of FIGS. 13-21, the bolt apparatus 2100 includes only a sliding bolt 1302, a bolt base 1700, and, in certain applications, one or more fasteners (not shown in FIGS. 13-21) to fasten the bolt base to structure such as a refuse container lid in but one example of where this bolt apparatus may be utilized. In this regard, the bolt base fastener passages 1701, 1702 of FIG. 17 are not considered a part of the ornamental design and may or may not be included in the bolt apparatus 2100 depending on the application and method of securing the bolt apparatus in position with respect to other structure.

Figure 20:
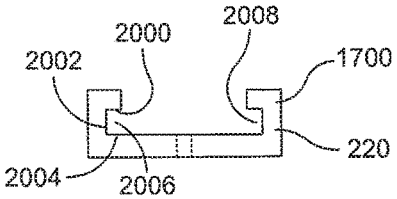
FIG. 20 is an elevational view of the surface bolt base of FIG. 17.
Figure 21:
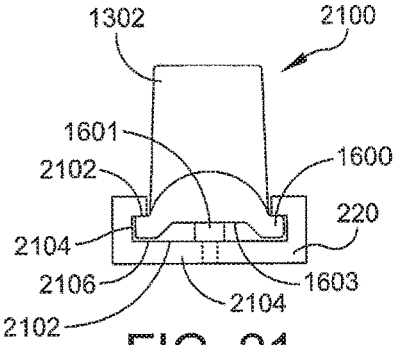
FIG. 21 is an elevational view of the surface bolt of FIG. 13 slidably mounted within a bolt channel within the surface bolt base of FIG. 17.

With reference now to FIG. 16, the bolt 1302 has opposed, laterally extending, planar bottom side sections 1600, 338. The bolt's laterally extending fastener channel 350 is intermediate the opposed bottom side sections 338, 1600 of the bolt 1302; and a bolt stop 1601 extends downwardly from the underside 1603 of the bolt 1302 to penetrate the fastener channel 350. With reference to FIGS. 20 and 21, the opposed bottom side sections 338, 1600 slidably penetrate, and are embraced on three sides, e.g., 2102, 2104, 2106, by, mating side walls, e.g., 2000, 2002, 2004, respectively, in laterally extending, opposed bolt side section retention channels 2006, 2008 in the bolt base 220. The downwardly extending bolt stop 1601 makes rubbing, frictional contact with the generally planar, laterally extending upper surface 2102 of the generally planar channel base 2104 extending between the opposed bolt side section retention channels 2006, 2008.

The resulting novel surface bolt apparatus 2100 can be relatively compact, easy to make and assemble (including onto a container bin sidewall), and lightweight and compact for shipping. One exemplary embodiment of the bolt apparatus 2100 (i.e., the bolt 1302 mounted to the bolt base 220 (less any fasteners)) is 2 inches long by 0.64 inches wide by 0.65 inches tall, and can weight as little as approximately 2 ounces when made of plastic for example. The bolt 1302 and bolt base 220 can be made of differing materials (including differing between them), such as composite material; and in some embodiments the bolt 1302 can be molded as a unitary part and the bolt base 220 can be extruded and then, if desired, punched to provide one or more fastener passages.

With reference now to FIGS. 22-30, an alternative hasp assembly 3000 includes an integral (unitary), generally rectangular, optionally extruded and punched hasp base plate 2200 having: (i) an inverted-T-shaped hasp channel 2202 laterally extending from the bottom end 2204 to the top end 2206 of the base plate 2200; (ii) a generally planar base extension section 2208 extending from, and coplanar with, the central section 2209 of the hasp channel 2202; and (iii) a spring mounting notch 2210 spaced from the lower right corner 2212 of the base plate 2200 in order to provide a spring mount arm 2214 extending outwardly from the base plate's lower right corner 2212.

Figure 25:
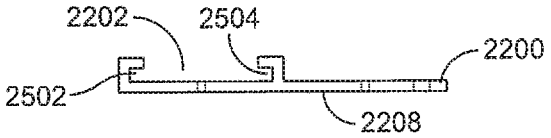
FIG. 25 is a front elevational view of the bolt base of FIG. 22.

With reference to FIGS. 26-30, a mating, integral, optionally molded hasp 2600 has a central thickened section 2602 having a generally curved upper surface 2604 extending between opposed laterally extending side sections 2606, 2608 and underside 2909 shaped much like the like the side sections and underside of the bolt 1302 described above with respect to FIG. 21. The opposed, three-walled side sections 2606, 2608 thus slidably mount within, as shown in FIG. 25, the matingly three-walled, opposed, laterally extending channels 2502, 2504 in the inverted-T-shaped laterally extending hasp channel 2202 in the hasp apparatus base plate 2200.

Figure 26:
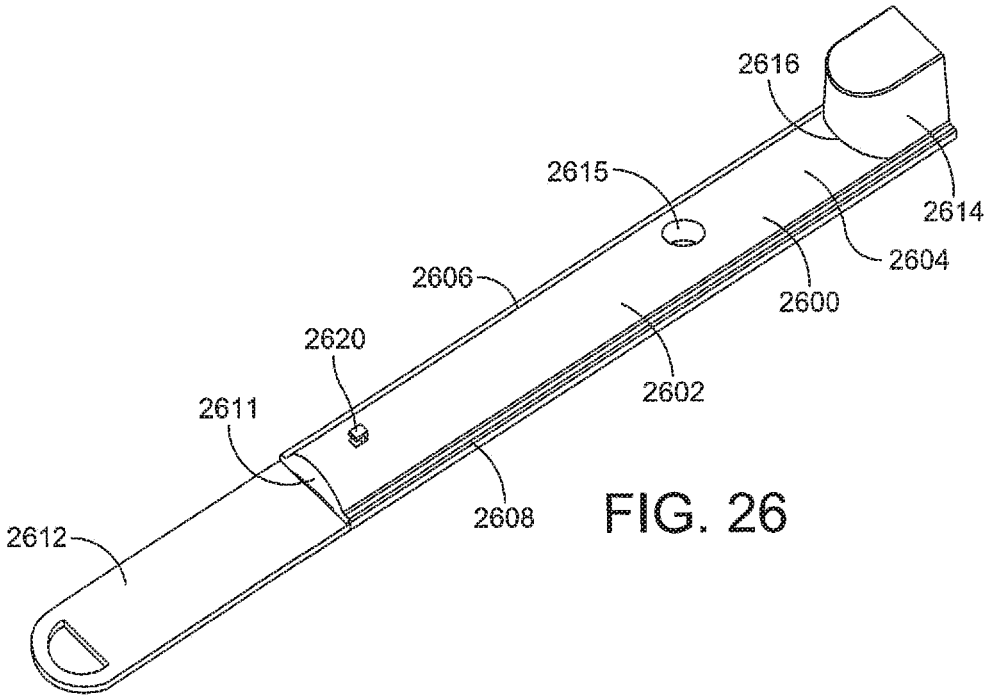
FIG. 26 is a perspective view of an alternative hasp mountable into a channel in the alternative hasp base of FIG. 22 and that can be molded in some embodiments.
Figure 27:
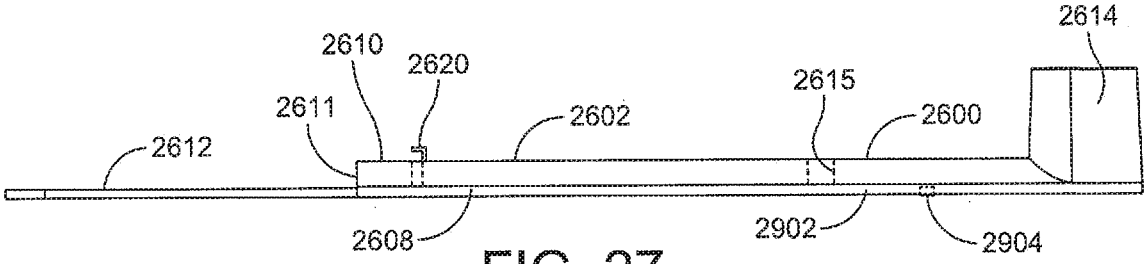
FIG. 27 is a side elevational view of the hasp of FIG. 26.
Figure 28:
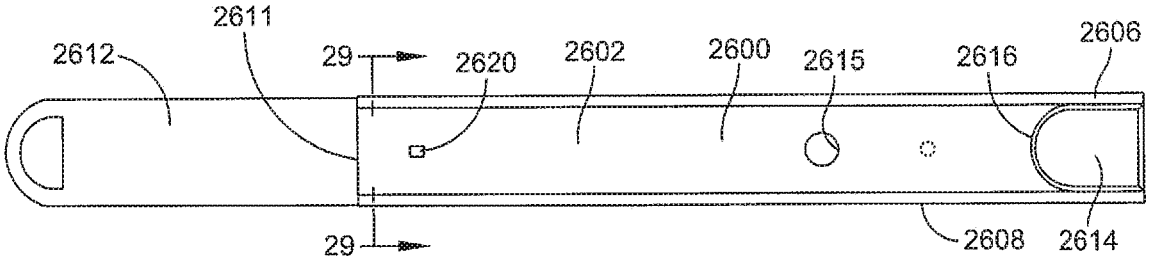
FIG. 28 is a plan view of the hasp of FIG. 26.
Figure 29:
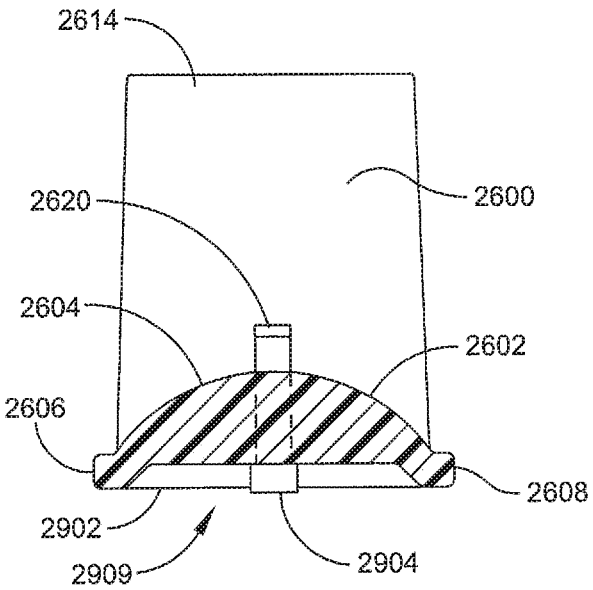
FIG. 29 is a front elevational view of the hasp of FIG. 26.
Figure 30:
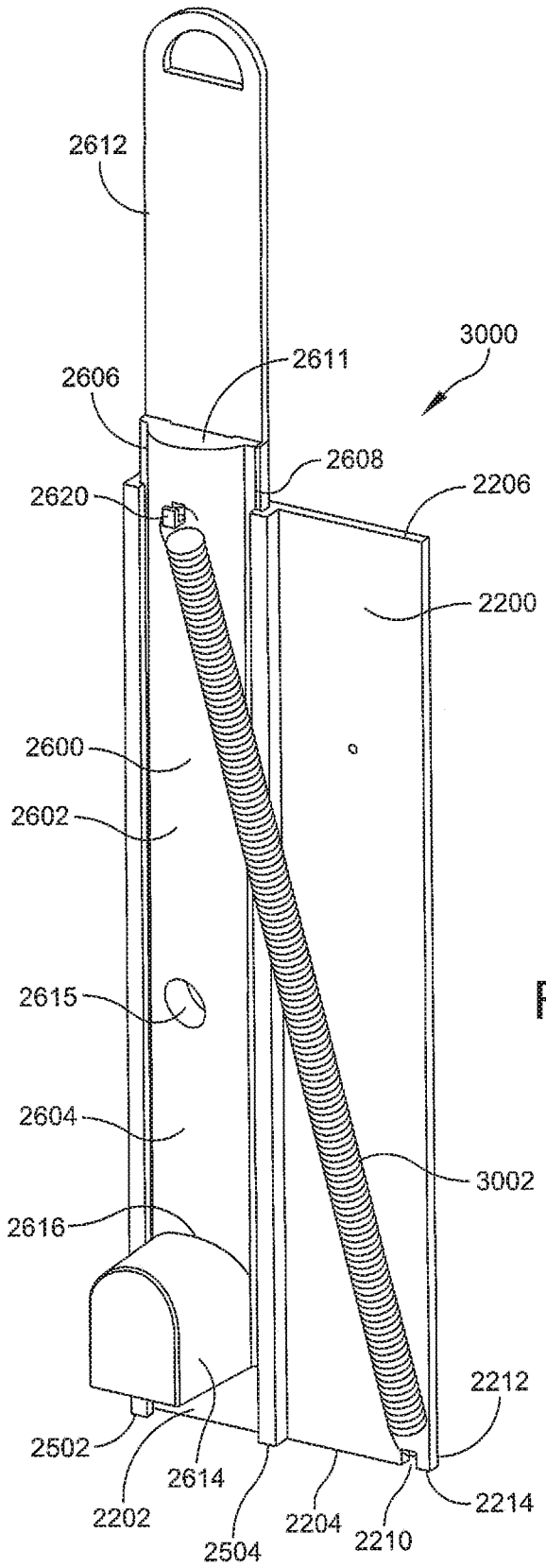
FIG. 30 is a perspective view of hasp apparatus assembly including the hasp and hasp base plate of FIGS. 22-29.

With reference to FIGS. 26-30, the molded hasp's thickened central section 2602 similarly includes a neck-stop 2611 at the upper end 2610 of the thickened central section 2602. The neck-stop 2611 transversely extends from a narrowed, laterally extending, generally planar working end 2612 of the hasp 2600. As shown in FIGS. 27 and 29, the underside 2909 of the hasp 2600 also includes a fastener channel 2902 and fastener stop 2904 projecting through the central section 2602 downwardly into the fastener channel 2902. As shown in FIGS. 26-28, the thickened central section 2602 of the hasp 2600 also includes a fastener access passage 2615 extending through the thickened central section 2602 transverse to the plane of the planar working end 2612 of the hasp 2600. The fastener access passage 2615 provides access to, with reference to FIG. 22, one or both of the hasp fastener passages 2205, 2207 in order to insert fasteners (not shown) into the passages 2205, 2207 after mounting of the hasp 2600 into the hasp base plate 2200.

Figure 22:
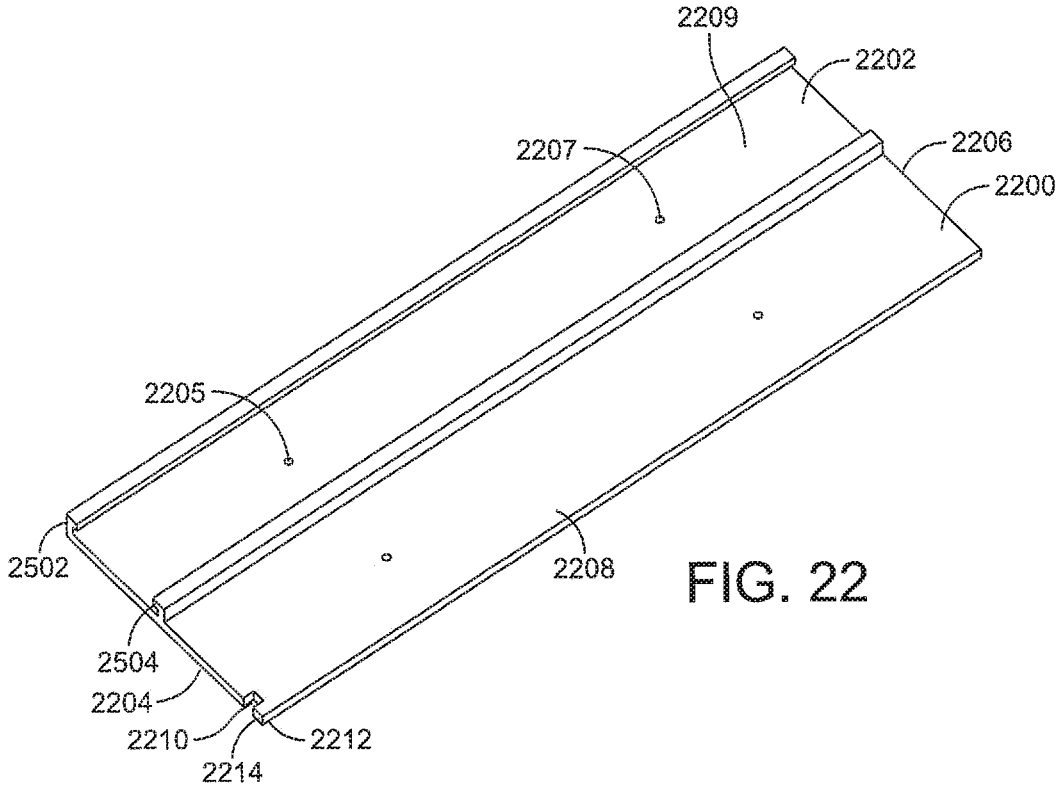
FIG. 22 is a perspective view of an alternative hasp base, which can be extruded and punched in some embodiments.
Figure 23:
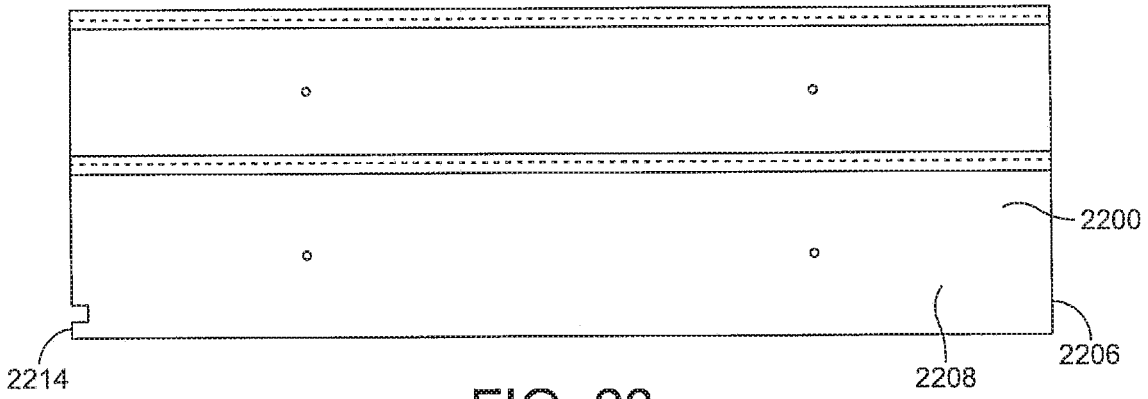
FIG. 23 is a plan view of the bolt base of FIG. 22.
Figure 24:
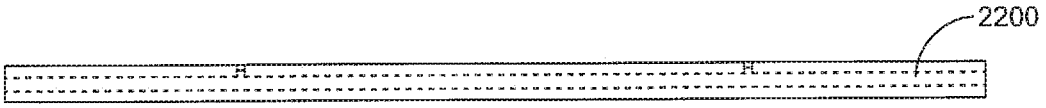
FIG. 24 is a side elevational view of the bolt base of FIG. 22.

As with the bolt 1302 described in association with FIG. 21 above, but referring now to FIGS. 22-30: (i) the molded hasp 2600 can thus be slidably mounted within the hasp channel 2202; and (ii) the movement of the molded hasp 2600 within the hasp channel 2202 can be constrained by the fastener stop 2904 intermediate, and abutting at extremes of permitted molded hasp 2600 movement between, laterally spaced-apart fastener heads (not shown) extending from, as shown in FIG. 22, two spaced-apart fastener passages, 2205, 2207 in the center of the hasp channel 2202.

With reference to FIG. 26, the molded hasp 2600 also includes a hand grippable knob 2614 extending transversely outwardly from the lower end 2616 of the central section 2602 of the molded hasp 2600. The molded hasp 2600 further includes an L-shaped spring mount bracket 2620 extending from the curved upper surface 2604 spaced from neck-stop 2611 in the hasp's central section 2602.

The resulting hasp and base plate assembly of FIGS. 22-30 has the hasp 2600 mounted within the hasp channel 2202 in the hasp base plate 2200 and a hasp biasing spring (not shown) mounted to, and extending between, the spring mount arm 2214 and spring mount bracket 2620. This hasp assembly 3000 also provides a unique ornamental design as does the hasp 2600 by itself and the hasp 2600 when assembled to the hasp base plate 2200.

In some embodiments, the molded hasp base plate 2200 and molded hasp 2600 of FIGS. 22-30 can be made of any suitable strong material. Exemplary such material can be strong plastic or composite material, though portions may be made of metal.

The resulting hasp assembly 3000 of FIGS. 22-30 can be very lightweight. It also can be economical to manufacture (especially in large quantities) and ship when formed of plastic, such as nylon, for example. In one embodiment, the resulting hasp assembly (less any fasteners that may be added) is made of nylon, weighs 0.25-1.0 lb. and is 8.12 inches tall, by 2.5 inches wide, by 0.7 inches deep.

Figure 31:
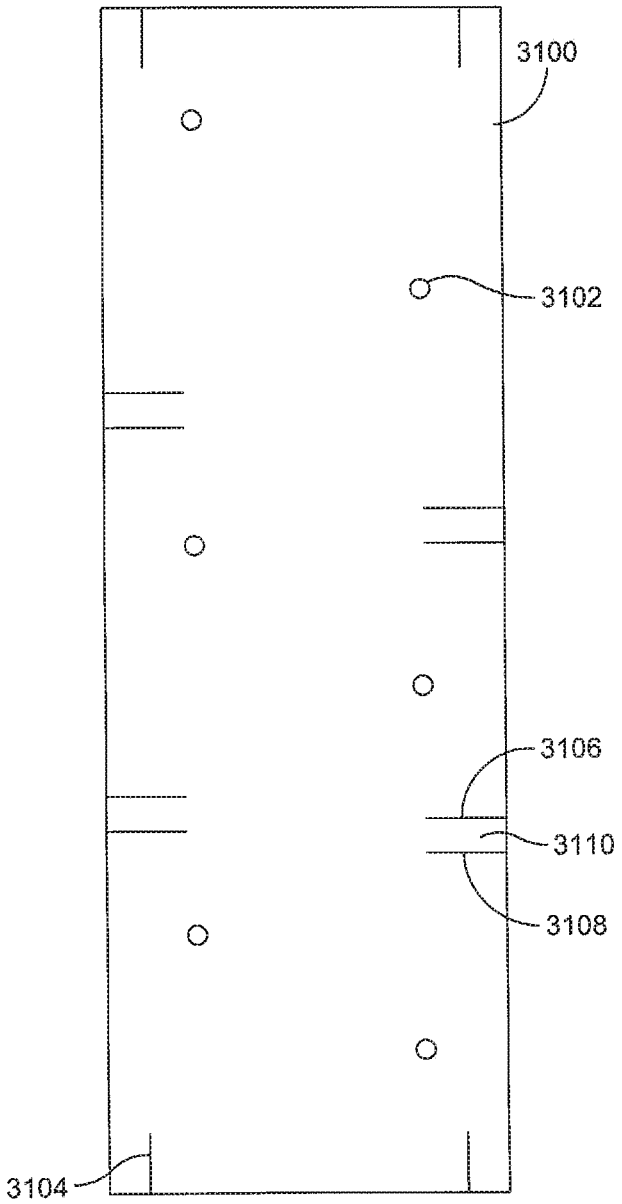
FIG. 31 is a plan view of an adapter plate providing a variety of fastener mounting passages and bendable tabs for mounting of hasp assembly to container bins having differing external configurations.

With reference not to FIG. 31, a hasp mounting adapter plate 3100 has six differing fastener mounting passages, e.g., 3102, spaced from each other and has a variety of tab formation cuts, e.g., 3104, 3106, 3108, stamped into the hasp adapter plate 3100. During mounting of a hasp assembly (not shown in FIG. 31) onto a given type of container bin, (i) select spacing tabs may be formed by bending a given tab section, e.g., 3110, formed by associated tab formation cuts, e.g., 3106, 3108, and (ii) differing fastener passages, e.g., 3102, can be utilized to mount the hasp adapter mounting plate to the bin and to mount a hasp assembly to the adapter plate 3100. This adapter plate 3100 thus can aid in mounting a hasp assembly to container bin (not shown in FIG. 31) having differing outer surface structure at the desired mounting location, such a sloped surface with respect to the plane of the upper edge and opening of the container bin. The adapter plate 3100 may be altered to provide yet other or differing fastener passages or tab or other cuts in order to adapt for use with differing containers as desired.

Figure 32:
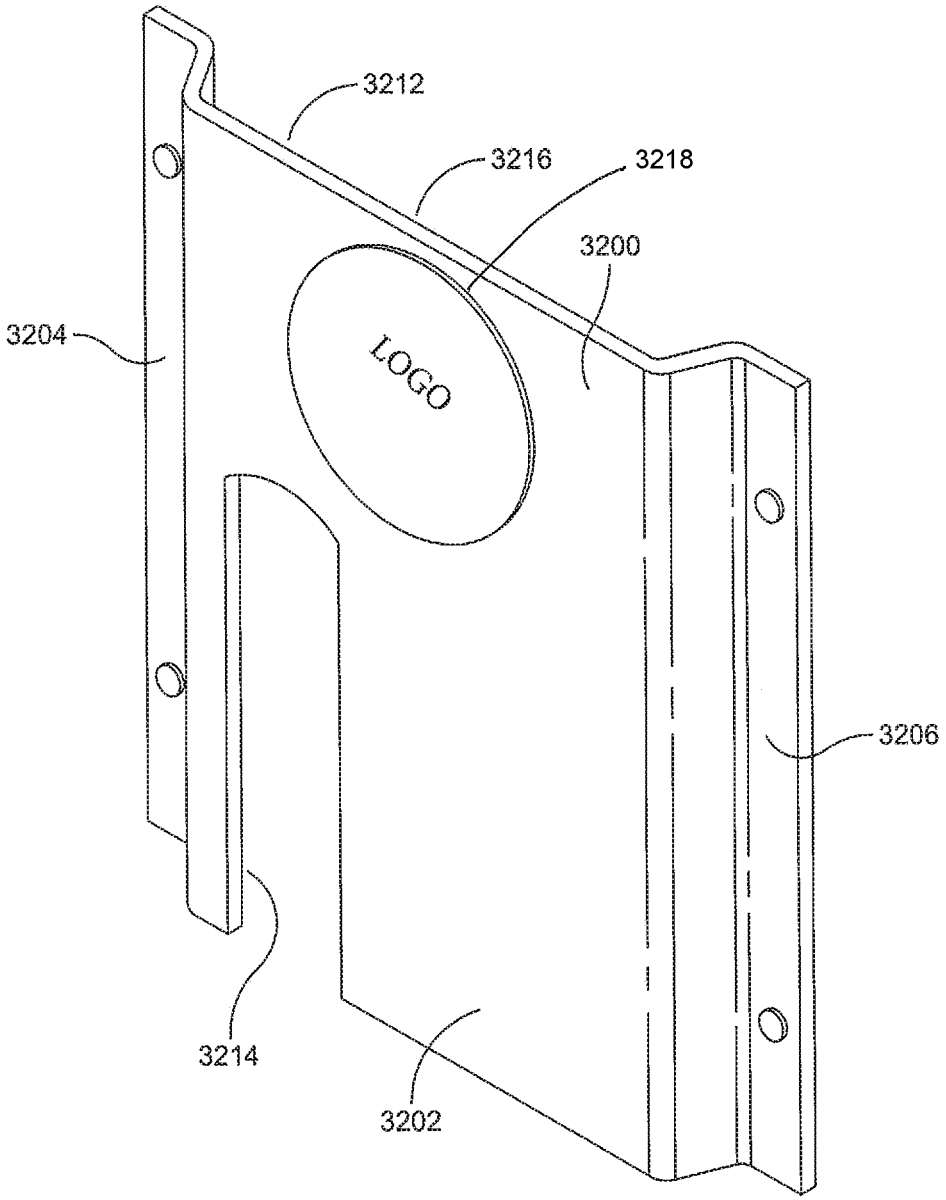
FIG. 32 is a perspective view of a hasp apparatus cover.

With reference to FIG. 32, a hasp apparatus cover plate 3200 has a somewhat planar cover central section 3202 spanning between opposed somewhat L-shaped, laterally extending side sections 3204, 3206. Each such side section, e.g., 3206, has spaced-apart fastener passages, e.g., 3208, 3210, penetrating the side section, e.g., 3206, transverse to the plane of the cover central section 3202. The cover plate upper end 3212 and opposed cover plate lower end 3214 are each open, providing a U-shaped hasp apparatus channel 3216 extending from the upper cover plate upper end 3212 to the cover plate lower end 3214. A raised circular plate 3218, on which a tradename, trademark, or other indicia may be placed in any suitable manner, is secured to, or formed within, the cover plate 3200 spaced from the cover plate upper end 3212. The cover plate 3200 may be extruded and stamped and may be formed of any suitably rigid and strong material such as metal (in one embodiment, aluminum for example), plastic, or composite.

Figure 33:
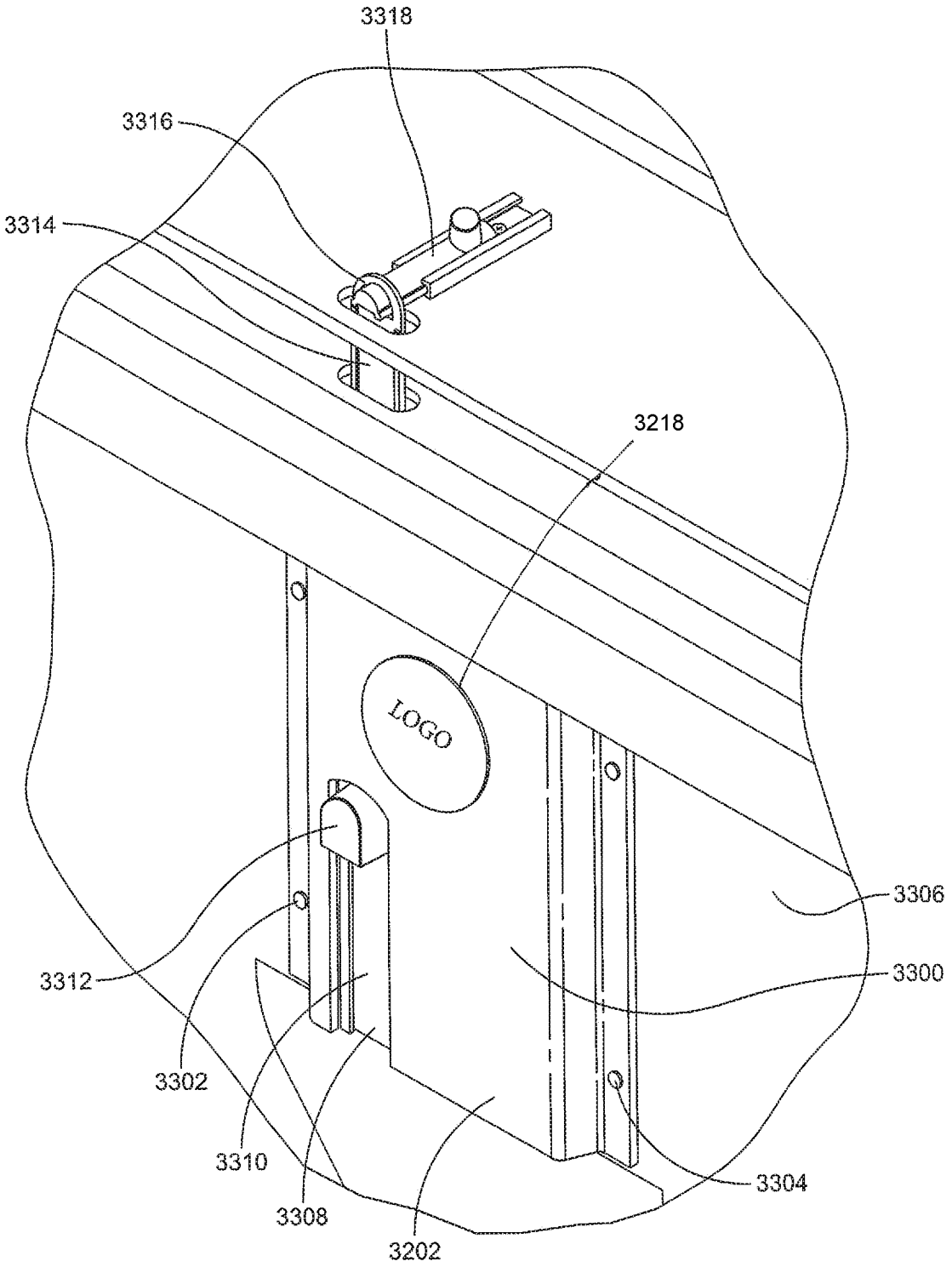
FIG. 33 is a perspective view of the hasp apparatus cover of FIG. 32 mounted to a container bin to cover the hasp apparatus of FIG. 30, which is also mounted the container bin in the hasp/bolt interlocked position.

Referring now to FIG. 33, the hasp apparatus cover plate 3300 can be secured by fasteners, e.g., 3302, 3304 (such as rivets for example) to a container bin sidewall 3306 to somewhat surround otherwise exposed portions of a hasp apparatus base plate 3308 also mounted to the container bin sidewall 3306. A laterally extending hasp handle slot 3310 penetrates the cover central section 3202 to allow a human hand (not shown) to push a hasp handle 3312 (or other hasp structure such as the bottom end (not shown in FIG. 33)) of a slidable hasp 3314 upwardly and downwardly in the hasp handle slot 3310, to thereby cause simultaneous upward and downward motion of the working end 3316 of the hasp 3314 and otherwise operate and secure the hasp 3314 with respect to the associated slidable surface bolt 3318 as otherwise explained with respect to, as shown in FIGS. 1-12, the slidable hasp apparatus 118 and slidable bolt apparatus 116 of FIGS. 1-12.

The structure of the hasp base plates disclosed herein may be altered to include various structures, such as spacer or mounting tabs extending from the back sides of the hasp base plates, in order to adapt the hasp base plates to mount to differently structured container bins. For example, in order to mount the base plate to align with an associated bolt assembly when the outer side of the container bin is sloped where one might like to mount a hasp base plate, tabs rearwardly extending from the base plate or an adapter plate can abut the sloped container side to adapt the hasp base plate to align at a differing angle than that of the sloped container side. Similar alterations may be made to a bolt base plate, to alter its alignment on a given container lid.

The interlockable hasp and bolt assemblies disclosed herein may be located elsewhere along the container sidewall and/or the container lid. Further multiple such assemblies may be utilized, such as on opposing sides of a container or in yet other locations in addition to, or differing from, a front side of a refuse container.

The disclosed refuse containers can be structured differently. A given refuse container may or may not have a generally square cross-section and may have a round cross-section for example. Similarly, the structure of the container lid and mating container bin structure may be different. The container bin may have no outwardly extending bin lip, and/or the container lid may have only one lid surface through which a hasp would pass. The present interlocking apparatus can be provided with adapter structure (such as one or more adapter plates, differing types of mounting tabs extending from a given base plate or adapter plate, etc.) to adapt the interlocking apparatus for use on differing types of refuse containers.

The hasp and bolt may be structured differently. In some embodiments, the hasp can be rotatable about one end or section, in order to rotate toward or away from a mating interlocking bolt. In some embodiments, the bolt can have a differing cross-section, providing for example a circular outer periphery. Such a bolt may be mountable into other bolt-mounting structure in order to accommodate the bolt and allow it to slide with respect to the bolt-mounting structure.

The term "laterally extending" means that the referenced component or feature has a lateral length at least 50% greater than the width of the component or feature.

All dimensions herein or in the Figures can be varied for varying circumstances, uses, and objects. They may be varied by ranges of plus or minus 0.01% through up to 1000% or even higher—also with the ranges in some embodiments varying by differing amounts for differing components.

In addition, the interlocking apparatus or their components may be utilized in other applications. For example, one or both of the novel hasp apparatus and novel bolt apparatus (or any of their components) may be utilized in other applications as desired.

The process parameters, functions, system features, and sequence of steps described and/or illustrated herein are given by way of example only and may be varied and mixed and matched as desired. The various exemplary methods described and/or illustrated herein may also omit one or more of the steps described or illustrated herein or include additional steps in addition to those disclosed.

The foregoing detailed description has described some specific embodiments. However, the illustrative discussions above are not intended to be exhaustive or to limit the invention to the precise forms disclosed. Many modifications and variations are possible in view of the above teachings. The embodiments were chosen and described in order to explain the principles of the present systems and methods and their practical applications, to thereby enable others skilled in the art to best utilize the present systems, their components, and methods and various embodiments with various modifications as may be suited to the particular use contemplated.

Unless otherwise noted, the terms "a" or "an," as used in the specification and claims, are to be construed as meaning "at least one of" In addition, for ease of use, the words "including" and "having," as used in the specification and claims, are interchangeable with and have the same meaning as the word "comprising." Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C).

Unless otherwise indicated, all numbers or expressions, such as those expressing dimensions, physical characteristics, and the like, used in the specification (other than the claims) are understood to be alternately modified in all instances by the term "approximately." At the very least, and not as an attempt to limit the application of the doctrine of equivalents to the claims, each numerical parameter recited in the specification or claims which alternately modified by the term "approximately" should at least be construed in light of the number of recited significant digits and by applying ordinary rounding techniques.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What I claim is:

1. A sealable refuse container comprising in combination:

a container bin having (i) a container sidewall extending from a closed container end to an open end and (ii) a container lid rotatably mounted adjacent the open end of the container bin to rotate to a closed position to close the open end; and a lid locking apparatus having:

a first locking arm mounted to the container sidewall linearly slidably between a first arm distal position spaced from the container lid and a first arm interlocking position adjacent the container lid, wherein the first locking arm includes a slidable hasp having a slotted end;

a second locking arm mounted on the container lid and being linearly slidable between a second arm distal position spaced from the first locking arm and a second arm interlocking in interlocking communication with the first locking arm when the lid is in the closed position; wherein the second locking arm includes a slidable bolt with a hasp slot penetrating end, and the second arm interlocking position includes the hasp slot penetrating end penetrating the slotted end of the hasp;

whereby the first locking arm can be linearly slidably interlocked to the second locking arm apparatus.

2. The sealable refuse container of claim 1 wherein the first locking arm is linearly slidably mounted on a base plate mounted on the container sidewall.

3. The sealable refuse container of claim 2 wherein the first locking arm is biased toward the first arm distal position.

4. The sealable refuse container of claim 1 wherein the second locking arm includes the slidable bolt slidably mounted to a bolt base mounted to the container lid.

5. The sealable refuse container of claim 2 wherein the second locking arm includes the slidable bolt slidably mounted to a bolt base mounted to the container lid.

6. The sealable refuse container of claim 4 wherein the slotted end of the first locking arm comprises a slot extending between opposed slot sidewalls.

7. A sealable refuse container comprising in combination:

a container bin having a container sidewall extending from a closed container end to an open end and (ii) a container lid rotatably mounted adjacent the open end of the container bin to rotate to a closed position to close the open end; and a lid locking apparatus having:

a first locking arm mounted to the container sidewall linearly slidably between a first arm distal position spaced from the container lid and a first arm interlocking position adjacent the container lid, wherein the first locking arm includes a slidable hasp having a slotted end and the first locking arm is biased toward the first arm distal position;

a second locking arm mounted on the container lid and being linearly slidable between a second arm distal position spaced from the first locking arm and a second arm interlocking position in interlocking communication with the first locking arm when the lid is in the closed position wherein the second locking arm includes a slidable bolt with a hasp slot penetrating end, and the second arm interlocking position includes the hasp slot penetrating end penetrating the slotted end of the hasp;

whereby the first locking arm can be linearly slidably interlocked to the second locking arm apparatus.

8. The sealable refuse container of claim 6 wherein the bias of the first locking arm toward the first arm distal position is provided by a biasing spring mounted to the base plate.

9. The sealable refuse container of claim 8 including a housing at least partially surrounding the hasp, base plate, and biasing spring.

10. The refuse container locking apparatus of claim 1, wherein the container sidewall surrounds an open container opposite the closed container end.

11. The sealable refuse container of claim 7 wherein biasing of the first locking arm toward the first arm distal position is provided by a biasing spring.

12. A sealable refuse container comprising in combination:

a container bin having (i) a container sidewall extending from a closed container end to an open end and (ii) a container lid rotatable mounted adjacent the open end of the container bin to rotate to a closed position to close the open end;

a lid locking apparatus having:

a first locking arm mounted to the container sidewall linearly slidably between a first arm distal position spaced from the container lid and a first arm interlocking position adjacent the container lid;

a housing at least partially surrounding the first locking arm portion extending from the container sidewall;

a second locking arm mounted on the container lid and being linearly slidable between a second arm distal position spaced from the first locking arm and a second arm interlocking position in interlocking communication with the first locking arm when the lid is in the closed position;

whereby the first locking arm can be linearly slidably interlocked to the second locking arm apparatus.

13. A sealable refuse container comprising in combination:

a container bin having (i) a container sidewall extending from a closed container end to an open end and (ii) a container lid rotatably mounted adjacent the open end of the container bin to rotate to a closed position to close the open end;

a lid locking apparatus having:

a locking hasp arm having a slotted end opposite distal hasp end, the locking hasp arm being mounted to a base plate mounted to the container sidewall with the first locking hasp arm being linearly slidable on the base plate between a first arm distal position spaced from the container lid and a first arm interlocking position adjacent the container lid;

a locking bolt mounted on a bolt base mounted on the container lid and being linearly slidable on the bolt base between a locking bolt distal position spaced from the container sidewall and a locking bolt interlocking position adjacent the container lid and in interlocking communication with the locking hasp arm when the lid is in the closed position;

wherein the locking hasp arm and locking bolt can be linearly slidably interlocked to each other.

14. The sealable refuse container of claim 13 having (i) a first arm biasing spring with a first spring end connected to the locking hasp arm and (ii) a second spring end opposite the first spring end and connected to the base plate.

15. A refuse container locking apparatus comprising in combination:

a first locking arm mounted to the container sidewall linearly slidable between a first arm distal position spaced from the container lid and a first arm interlocking position adjacent the container lid, the first interlocking arm including:

(i) a slidable hasp having (A) a hasp fastener channel intermediate, and provided by, two opposed hasp fastener channel lip sections and (B) a hasp stop protrusion penetrating the hasp fastener channel; and (ii) a hasp base providing a hasp mounting channel intermediate two opposed hasp mounting channel sidewall sections; and a second locking arm mounted on the container lid and being linearly slidable between a second arm distal position spaced from the first locking arm and a second arm interlocking position in interlocking communication with the first locking arm, the second interlocking arm apparatus including:

(i) a slidable bolt having (A) a bolt fastener channel intermediate, and provided by, two opposed bolt fastener channel lip sections and (B) a hasp stop protrusion penetrating the hasp fastener channel; and (ii) a bolt base providing a bolt mounting channel intermediate two opposed bolt mounting channel sidewall sections;

whereby the first locking arm can be linearly slidably interlocked to the second locking arm.

16. The refuse container locking apparatus of claim 15 wherein (i) the slidable hasp is mounted within the hasp mounting channel on the hasp base and (ii) the slidable bolt is mounted within the bolt mounting channel in the bolt base.

17. The refuse container locking apparatus of claim 16 also including a refuse container having a refuse container lid rotatably mounted to a refuse container bin and wherein (i) the hasp base is mounted to the refuse container bin and (ii) the bolt base is mounted to the refuse container lid.

* * * * *